US006246423B1

(12) United States Patent
Suzuki et al.

(10) Patent No.: US 6,246,423 B1
(45) Date of Patent: Jun. 12, 2001

(54) MANUAL THERMAL WRITING DEVICE FOR FORMING IMAGE ON IMAGE-FORMING SUBSTRATE

(75) Inventors: Minoru Suzuki, Tochigi; Hiroshi Orita; Hiroyuki Saito, both of Saitama; Katsuyoshi Suzuki; Koichi Furusawa, both of Tokyo, all of (JP)

(73) Assignee: Asahi Kogaku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/323,685

(22) Filed: Jun. 2, 1999

(30) Foreign Application Priority Data

Jun. 3, 1998 (JP) ..... 10-154027

(51) Int. Cl.[7] ..... B41J 3/39
(52) U.S. Cl. ..... 346/76.1; 347/109
(58) Field of Search ..... 346/76.1, 111, 346/112, 143, 139 R; 347/109; 407/30, 62, 82, 99, 206

(56) References Cited

U.S. PATENT DOCUMENTS

| | | | |
|---|---|---|---|
| 4,399,209 | 8/1983 | Sanders et al. | 430/138 |
| 4,440,846 | 4/1984 | Sanders et al. | 430/138 |
| 4,644,376 | 2/1987 | Usami et al. | 346/215 |
| 4,748,460 * | 5/1988 | Piatt et al. | 347/109 |
| 5,641,418 * | 6/1997 | Chou | 219/229 |
| 5,825,985 | 10/1998 | Asai et al. | 395/108 |

FOREIGN PATENT DOCUMENTS

| | | |
|---|---|---|
| 2193687 | 2/1988 | (GB) . |
| 4-4960 | 1/1992 | (JP) . |

* cited by examiner

*Primary Examiner*—N. Le
*Assistant Examiner*—Anh T. N. Vo
(74) *Attorney, Agent, or Firm*—Greenblum & Bernstein P.L.C.

(57) ABSTRACT

Using a thermal writing device, an image is drawn on an image-forming sheet that includes a base and a layer of microcapsules, coated over the base, containing microcapsules filled with a dye. The microcapsules are squashed under a predetermined pressure at a temperature falling in a predetermined temperature range. The device includes an elongated body, having a tip-end, designed to be grasped by a user's hand, a heater movably provided on the tip-end of the body, and a spring provided in the tip-end of the body. The spring is associated with the heater to be elastically biased such that, when the tip-end of the body is pressed against the sheet, the heater is depressed against an elastic-force of the spring, thereby exerting the predetermined pressure on the sheet. An electrical driver that electrically energizes the heater to heat to a temperature falling in the predetermined temperature range is also provided.

13 Claims, 18 Drawing Sheets

MANUAL THERMAL WRITING DEVICE FOR FORMING IMAGE ON IMAGE-FORMING SUBSTRATE

BACKGROUND OF THE INVENTION

1. Field of the Invention

The present invention relates to a manual thermal writing device for forming an image on an image-forming substrate that is coated with a layer of microcapsules filled with dye or ink, by selectively squashing or breaking the microcapsules in the layer of microcapsules.

2. Description of the Related Art

As a type of microcapsule, contained in the layer of microcapsules of the image-forming substrate, there is proposed a microcapsule that exhibits a pressure/temperature breaking characteristic such that, when the microcapsule is squashed and broken under a predetermined pressure at a predetermined temperature, the microcapsule breaks discharging the dye or ink. Thus, by suitably controlling a temperature and a pressure, which should be exerted on the image-forming sheet 10, it is possible to selectively squash and break the microcapsules of the microcapsule layer of the image-forming substrate in accordance with image information, whereby an image can be formed on the microcapsule layer.

On the other hand, to form an image on the microcapsule layer of the image-forming substrate, a printer type of image-forming apparatus is proposed, but other types of image-forming apparatus are not proposed. Of course, before the aforementioned type of image-forming substrate can come into wide use, it is necessary to develop a manual writing device for clearly and easily forming an image on the microcapsule layer of the image-forming substrate without using the printer type of image-forming apparatus.

SUMMARY OF THE INVENTION

Therefore, an object of the present invention is to provide to a manual thermal writing device by which an image can be easily formed on a layer of microcapsules of the aforementioned image-forming substrate.

In accordance with an aspect of the present invention, there is provided a pen-type thermal writing device that draws an image on an image-forming substrate including a base member and a layer of microcapsules, coated over the base member, containing microcapsules filled with a dye, the microcapsules exhibiting a pressure/temperature characteristic such that the microcapsules are squashed under a predetermined pressure at a temperature falling in a predetermined temperature range. The pen-type thermal writing device comprises: an elongated body, having a tip-end, designed to be grasped by a hand; a heater element movably provided on the tip-end of the elongated body; an elastic element, generating an elastic-force, provided in the tip-end of the elongated body and associated with the heater element to be elastically biased such that, when the tip-end of the elongated body is pressed against the image-forming substrate, the heater element is depressed against the elastic-force of the elastic member, thereby exerting the predetermined pressure on the image-forming substrate; and an electrical driver that electrically energizes the heater element to heat to the temperature falling in the predetermined temperature range.

Preferably, the heater element is positioned to protrude from an end face defined by the tip-end of the elongated body when separated from the image-forming substrate, and a pressure, exerted by the heater element on the image-forming substrate, reaches the predetermined pressure when the heater element is depressed from the protruding position to the end face by pressing the tip-end of the elongated body against the image-forming substrate.

The pen-type thermal writing device may further comprises a determiner that determines whether the heater element is depressed from the protruding position to the end face when pressing the tip-end of the elongated body against the image-forming substrate, and a controller that controls the electrical driver such that the electrical energization of the heater element is started when the depression of the heater elements from the protruding position to the end face is confirmed by the determiner. In this case, preferably, the pen-type thermal writing device is provided with an indicator that indicates that the pressure, exerted by the heater element on the image-forming substrate, reaches the predetermined pressure when the depression of the heater elements from the protruding position to the end face is confirmed by the determiner.

Also, the pen-type thermal writing device may further comprises an adjuster that sets a temperature within the predetermined temperature range to which the heater element is heated, and a controller that controls the electrical energization of the heater element by the electrical driver such that a heating temperature of the heater element coincides with the temperature set by the adjuster.

In accordance with another aspect of the present invention, there is provided a stamp-type thermal writing device that forms an image on an image-forming substrate including a base member and a layer of microcapsules, coated over the base member, containing microcapsules filled with a dye, the microcapsules exhibiting a pressure/temperature characteristic such that the microcapsules are squashed under a predetermined pressure range at a predetermined temperature. The stamp-type thermal writing device comprises: a body member; a plate member movably associated with the body; an elastic element interposed between the body member and the plate member; a plurality of heater elements regularly arranged over an outer surface of the plate member; a pressure detector that detects a pressure exerted by the outer surface of the plate member on the image-forming substrate, when the body member is pressed against the image-forming substrate, the outer surface of the plate member being in contact with the image-forming substrate; an electrical driver that selectively and electrically energizes the heater elements in accordance with image-pixel data; a pressure-lowering monitor that monitors whether a pressure, once exerted by the outer surface of the plate member on the image-forming substrate and increased to more than a previously-set pressure falling in the predetermined pressure range, lowers to the previously-set pressure; and a controller that controls the electrical driver such that the selective and electrical energization of the heater elements is started and maintained over a predetermined time period to heat to the predetermined temperature, when it is confirmed by the monitor that the pressure exerted by the outer surface of the plate member on the image-forming substrate reaches the previously-set pressure.

The stamp-type thermal writing device may further comprises a maximum-pressure-reaching determiner that determines whether the pressure exerted by the outer surface of the plate member on the image-forming substrate reaches a maximum pressure defining the predetermined pressure range; and an indicator that indicates the pressure exerted by the outer surface of the plate member on the image-forming substrate reaches the maximum pressure defining the predetermined pressure range when it is determined by the maximum-pressure-reaching determiner. In this case, the pressure-lowering monitor monitors whether the maximum pressure lowers to the previously-set pressure, and the controller controls the electrical driver such that the selective and electrical energization of the heater elements is started and maintained over the predetermined time period to heat to the predetermined temperature, when it is confirmed by the monitor that the maximum pressure exerted by the outer surface of the plate member on the image-forming substrate reaches the previously-set pressure. Also, the stamp-type thermal writing device may be provided with a memory that stores the image-pixel data.

In the present invention, the image-forming substrate may be formed as a color image-forming substrate. In this case, the microcapsule layer of the image-forming substrate is formed of at least two types of microcapsules: a first type of microcapsule filled with a first dye; and a second type of microcapsule filled with a second dye. The first type of microcapsule exhibits a first pressure/temperature characteristic such that the first type of microcapsule is squashed under a first predetermined pressure at a temperature falling in a first predetermined temperature range, and the second type of microcapsule exhibits a second pressure/temperature characteristic such that the second type of microcapsule is squashed under a second predetermined pressure at a temperature falling in a second predetermined temperature ranging.

Another pen-type thermal writing device, that draws a color image on the color image-forming substrate, comprises: an elongated body, having a tip-end, designed to be grasped by a hand; a first heater element movably provided on the tip-end of the elongated body; a first elastic element, generating a first elastic-force, provided in the tip-end of the elongated body and associated with the first heater element to be elastically biased such that, when the tip-end of the elongated body is pressed against the image-forming substrate, the first heater element is depressed against the first elastic-force of the first elastic member, thereby exerting the first predetermined pressure on the image-forming substrate; a first electrical driver that electrically energizes the first heater element to heat to a temperature falling in the first predetermined temperature range; a second heater element movably provided on the tip-end of the elongated body; a second elastic element, generating a second elastic-force, provided in the tip-end of the elongated body and associated with the second heater element to be elastically biased such that, when the tip-end of the elongated body is pressed against the image-forming substrate, the second heater element is depressed against the second elastic-force of the second elastic member, thereby exerting the second predetermined pressure on the image-forming substrate; and a second electrical driver that electrically energizes the second heater element to heat to a temperature falling in the second predetermined temperature range.

Preferably, each of the first and second heater elements may be positioned to protrude from an end face defined by the tip-end of the elongated body when separated from the image-forming substrate, and respective pressures, exerted by the first and second heater elements on the image-forming substrate, reach the first and second predetermined pressures when the heater element are depressed from the protruding positions to the end face by pressing the tip-end of the elongated body against the image-forming substrate.

The pen-type thermal writing device may further comprises a determiner that determines whether the first and second heater elements are depressed from the protruding positions to the end face when pressing the tip-end of the elongated body against the image-forming substrate, a first controller that controls the first electrical driver such that the electrical energization of the first heater element is started when the depression of the first and second heater elements from the protruding position to the end face is confirmed by the determiner, and a second controller that controls the first electrical driver such that the electrical energization of the second heater element is started when the depression of the first and second heater elements from the protruding position to the end face is confirmed by the determiner. In this case, preferably, the pen-type thermal writing device is provided with an indicator that indicates that the respective pressures, exerted by the first and second heater elements on the image-forming substrate, reach the first and second predetermined pressures when it is determined by the determiner that the first and second respective heater elements are depressed from the protruding positions to the end face when pressing the tip-end of the elongated body against the image-forming substrate.

Also, the pen-type thermal writing device may further comprises a first adjuster that sets a temperature within the first predetermined temperature range to which the first heater element is heated, a first controller that controls the electrical energization of the first heater element by the first electrical driver such that a heating temperature of the first heater element coincides with the temperature set by the first adjuster, a second adjuster that sets a temperature within the second predetermined temperature range to which the second heater element is heated, and a second controller that controls the electrical energization of the second heater element by the second electrical driver such that a heating temperature of the second heater element coincides with the temperature set by the second adjuster.

Another stamp-type thermal writing device, that draws a color image on the color image-forming substrate, comprises: a body member; a plate member movably associated with the body; an elastic element interposed between the body member and the plate member; a first type of heater element and a second type of heater element regularly arranged over an outer surface of the plate member; a pressure detector that detects a pressure exerted by the outer surface of the plate member on the image-forming substrate, while the body member is pressed against the image-forming substrate, the outer surface of the plate member being in contact with the image-forming substrate; a first electrical driver that selectively and electrically energizes the first type of heater element in accordance with first image-pixel data; a second electrical driver that selectively and electrically energizes the second type of heater element in accordance with second image-pixel data; a first pressure-lowering monitor that monitors whether a pressure, once exerted by the outer surface of the plate member on the image-forming substrate and increased to more than a first previously-set pressure falling in the first predetermined pressure range, lowers to the first previously-set pressure falling in the first predetermined pressure range; a second pressure-lowering monitor that monitors whether the pressure exerted by the outer surface of the plate member on the image-forming substrate then lowers to a second previously-set pressure falling in the second predetermined pressure range; a first controller that controls the first electrical driver such that the selective and electrical energization of the first type of heater element is started and maintained over a first predetermined time period to heat to the first predetermined temperature, when it is confirmed by the monitor that the pressure exerted by the outer surface of the plate member on the image-forming substrate reaches the first previously-set pressure; and a second controller that controls the second electrical driver such that the selective and electrical energization of the second type of heater element is started and maintained over a second predetermined time period to heat to the second predetermined temperature, when it is confirmed by the monitor that the pressure exerted by the outer surface of the plate member on the image-forming substrate reaches the second previously-set pressure.

The stamp-type thermal writing device may further comprises a maximum-pressure-reaching determiner that determines whether the pressure exerted by the outer surface of the plate member on the image-forming substrate reaches a maximum pressure defining the first predetermined pressure range, and an indicator that indicates the pressure exerted by the outer surface of the plate member on the image-forming substrate reaches the maximum pressure defining the first predetermined pressure range when it is determined by the maximum-pressure-reaching determiner. In this case, the first pressure-lowering monitor monitors whether the maximum pressure lowers to the first previously-set pressures, the second pressure-lowering monitor monitors whether the maximum pressure lowers to the second previously-set pressure, the first controller controls the electrical driver such that the selective and electrical energization of the first heater elements is started and maintained over the first predetermined time period to heat to the first predetermined temperature, when it is confirmed by the monitor that the maximum pressure exerted by the outer surface of the plate member on the image-forming substrate reaches the first previously-set pressure, and the second controller controls the electrical driver such that the selective and electrical energization of the-second heater elements is started and maintained over the second predetermined time period to heat to the second predetermined temperature, when it is confirmed by the monitor that the maximum pressure exerted by the outer surface of the plate member on the image-forming substrate reaches the second previously-set pressure. Also, the stamp-type thermal writing device may be provided with a memory that stores the first and second image-pixel data.

BRIEF DESCRIPTION OF THE DRAWINGS

The object and other objects of the present invention will be better understood from the following description, with reference to the accompanying drawings in which.

DESCRIPTION OF THE PREFERRED EMBODIMENTS

Figure 1:
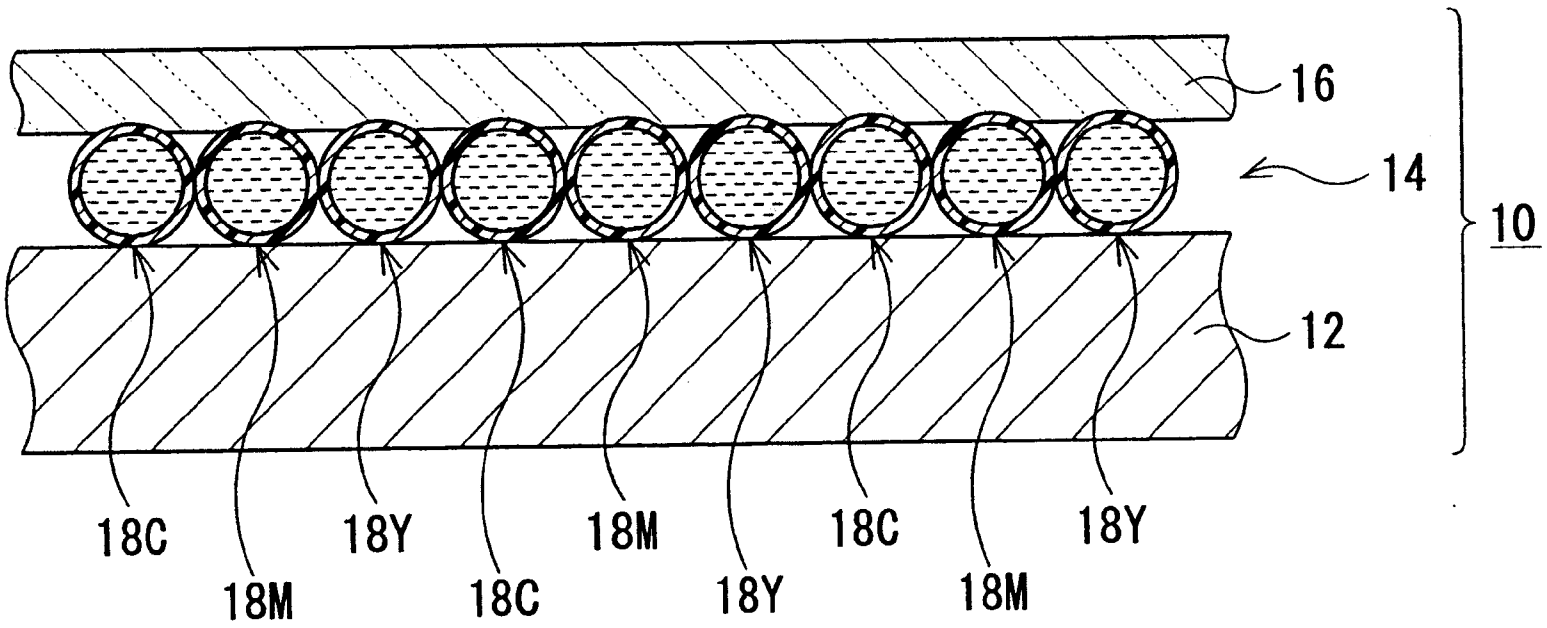
FIG. 1 is a schematic conceptual cross-sectional view showing an image-forming substrate, comprising a layer of microcapsules including a first type of cyan microcapsules filled with a cyan dye, a second type of magenta microcapsules filled with a magenta dye and a third type of yellow microcapsules filled with a yellow dye, used with a manual thermal writing device according to the present invention.

FIG. 1 shows an image-forming substrate, generally indicated by reference 10, on which an image can be formed with a manual thermal writing device according to the present invention. The image-forming substrate 10 is produced in a form of a paper sheet. Namely, the image-forming substrate or sheet 10 comprises a sheet of paper 12, a layer of microcapsules 14 coated over a surface of the paper sheet 12, and a sheet of protective transparent plastic film 16 covering the microcapsule layer 14.

The microcapsule layer 14 is formed from three types of microcapsules: a first type of microcapsules 18C filled with cyan liquid dye or ink, a second type of microcapsules 18M filled with magenta liquid dye or ink, and a third type of microcapsules 18Y filled with yellow liquid dye or ink, and these microcapsules 18C, 18M and 18Y are uniformly distributed in the microcapsule layer 14. In each type of microcapsule (18C, 18M, 18Y), a shell wall of a microcapsule is formed of a synthetic resin material, usually colored white. Also, each type of microcapsule (18C, 18M, 18Y) may be produced by a well-known polymerization method, such as interfacial polymerization, in-situ polymerization or the like, and may have an average diameter of several microns, for example, 5 $\mu$m to 10 $\mu$m.

Note, when the paper sheet 12 is colored with a single color pigment, the resin material of the microcapsules 18C, 18M and 18Y may be colored by the same single color pigment.

For the uniform formation of the microcapsule layer 14, for example, the same amounts of cyan, magenta and yellow microcapsules 18C, 18M and 18Y are homogeneously mixed with a suitable binder solution to form a suspension, and the paper sheet 12 is coated with the binder solution, containing the suspension of microcapsules 18C, 18M and 18Y, by using an atomizer.

Note, in FIG. 1, for the convenience of illustration, although the microcapsule layer 14 is shown as having a thickness corresponding to the diameter of the microcapsules 18C, 18M and 18Y, in reality, the three types of microcapsules 18C, 18M and 18Y overlay each other, and thus the microcapsule layer 14 has a larger thickness than the diameter of a single microcapsule 18C, 18M or 18Y.

In the image-forming sheet 10, for the resin material of each type of microcapsule (18C, 18M, 18Y), a shape memory resin may be utilized. As is well known, for example, the shape memory resin is represented by a polyurethane-based-resin, such as polynorbornene, trans-1, 4-polyisoprene polyurethane. As other types of shape memory resin, a polyimide-based resin, a polyamide-based resin, a polyvinyl-chloride-based resin, a polyester-based resin and so on are also known.

Figure 2:
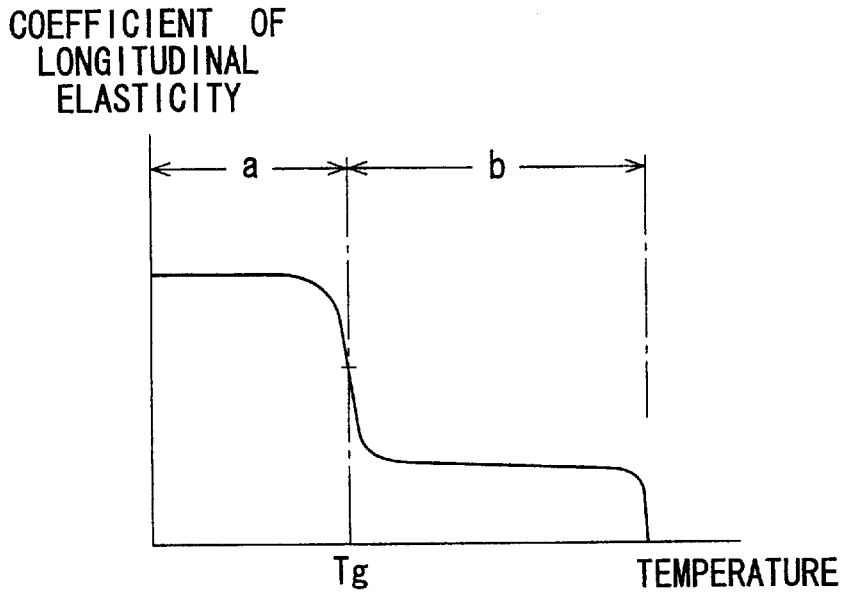
FIG. 2 is a graph showing a characteristic curve of a longitudinal elasticity coefficient of a shape memory resin.

In general, as is apparent from a graph of FIG. 2, the shape memory resin exhibits a coefficient of longitudinal elasticity, which abruptly changes at a glass-transition temperature boundary $T_g$. In the shape memory resin, Brownian movement of the molecular chains is stopped in a low-temperature area "a", which is less than the glass-transition temperature $T_g$, and thus the shape memory resin exhibits a glass-like phase. On the other hand, Brownian movement of the molecular chains becomes increasingly energetic in a high-temperature area "b", which is higher than the glass-transition temperature $T_g$, and thus the shape memory resin exhibits a rubber elasticity.

The shape memory resin is named due to the following shape memory characteristic: after a mass of the shape memory resin is worked into a shaped article in the low-temperature area "a", when such a shaped article is heated over the glass-transition temperature $T_g$, the article becomes freely deformable. After the shaped article is deformed into another shape, when the deformed article is cooled to below the glass-transition temperature $T_g$, the other shape of the article is fixed and maintained. Nevertheless, when the deformed article is again heated to above the glass-transition temperature $T_g$, without being subjected to any load or external force, the deformed article returns to the original shape.

In the image-forming sheet 10, the shape memory characteristic per se is not utilized, but the characteristic abrupt change of the shape memory resin in the longitudinal elasticity coefficient is utilized, such that the three types of microcapsules 18C, 18M and 18Y can be selectively squashed and broken at different temperatures and under different pressures, respectively.

Figure 3:
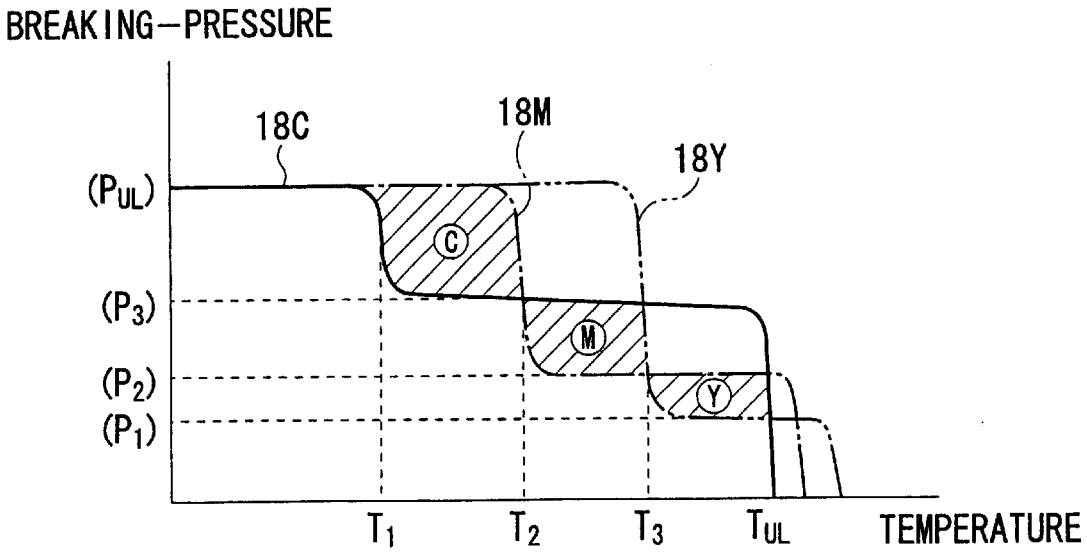
FIG. 3 is a graph showing pressure/temperature breaking characteristics of the respective cyan, magenta and yellow microcapsules shown in FIG. 1, with each of a cyan-developing area, a magenta-developing area and a yellow-developing area being indicated as a hatched area.

As shown in a graph of FIG. 3, a shape memory resin of the cyan microcapsules 18C is prepared so as to exhibit a characteristic longitudinal elasticity coefficient, indicated by a solid line, having a glass-transition temperature $T_1$; a shape memory resin of the magenta microcapsules 18M is prepared so as to exhibit a characteristic longitudinal elasticity coefficient, indicated by a single-chained line, having a glass-transition temperature $T_2$; and a shape memory resin of the yellow microcapsules 18Y is prepared so as to exhibit a characteristic longitudinal elasticity coefficient, indicated by a double-chained line, having a glass-transition temperature $T_3$.

Note, by suitably varying compositions of the shape memory resin and/or by selecting a suitable one from among various types of shape memory resin, it is possible to obtain the respective shape memory resins, with the glass-transition temperatures $T_1$, $T_2$ and $T_3$. For example, the glass-transition temperatures $T_1$, $T_2$ and $T_3$ may be set to 70° C., 110° C. and 130° C., respectively.

Figure 4:
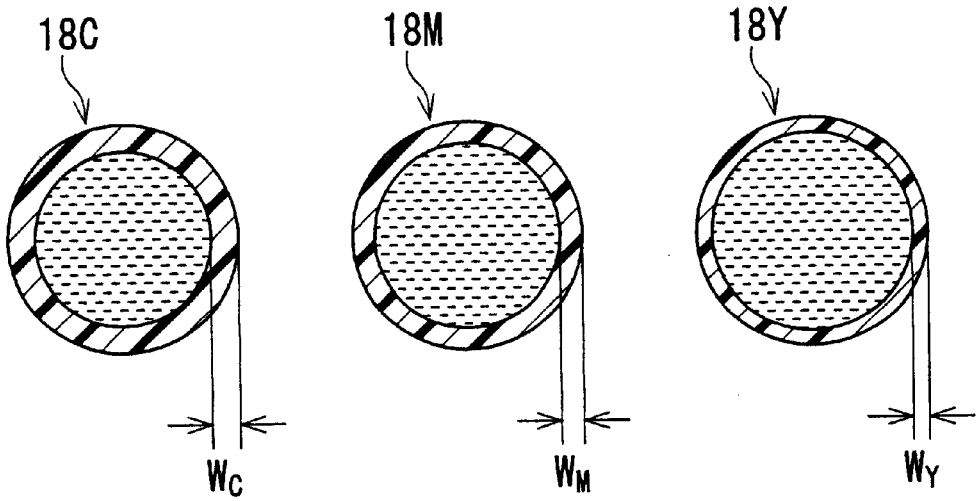
FIG. 4 is a schematic cross-sectional view showing different shell wall thicknesses of the respective cyan, magenta and yellow microcapsules.

As shown in FIG. 4, the microcapsule walls of the cyan microcapsules 18C, magenta microcapsules 18M, and yellow microcapsules 18Y have differing thicknesses $W_C$, $W_M$ and $W_Y$, respectively. Namely, the thickness $W_C$ of cyan microcapsules 18C is larger than the thickness $W_M$ of magenta microcapsules 18M, and the thickness $W_M$ of magenta microcapsules 18M is larger than the thickness $W_Y$ of yellow microcapsules 18Y.

Also, the wall thickness $W_C$ of the cyan microcapsules 18C is selected such that each cyan microcapsule 18C is compacted and broken under a breaking-pressure that lies between a critical breaking-pressure $P_3$ and an upper limit pressure $P_{UL}$ (FIG. 3), when each cyan microcapsule 18C is heated to a temperature between the glass-transition temperatures $T_1$ and $T_2$; the wall thickness $W_M$ of the magenta microcapsules 18M is selected such that each magenta microcapsule 18M is compacted and broken under a breaking-pressure that lies between a critical breaking-pressure $P_2$ and the critical breaking-pressure $P_3$ (FIG. 3), when each magenta microcapsule 18M is heated to a temperature between the glass-transition temperatures $T_2$ and $T_3$; and the wall thickness $W_Y$ of the yellow microcapsules 18Y is selected such that each yellow microcapsule 18Y is compacted and broken under a breaking-pressure that lies between a critical breaking-pressure $P_1$ and the critical breaking-pressure $P_2$ (FIG. 3), when each yellow microcapsule 18Y is heated to a temperature between the glass-transition temperature $T_3$ and an upper limit temperature $T_{UL}$.

Note, for example, the breaking-pressures $P_1$, $P_2$, $P_3$ and $P_{UL}$ may be set to 0.02, 0.2, 2.0 and 20 MPa, respectively, and a wall thickness of a microcapsule (18C, 18M, 18Y) concerned is selected such that it is compacted and broken under a given breaking-pressure when it is heated to a given temperature. Also, note, the upper limit temperature $T_{UL}$ is suitably set to, for example, 150° C.

Thus, by suitably selecting a heating temperature and a breaking-pressure, which should be exerted on the image-forming sheet 10, it is possible to selectively squash and break the cyan, magenta and yellow microcapsules 18C, 18M and 18Y.

Figure 5:
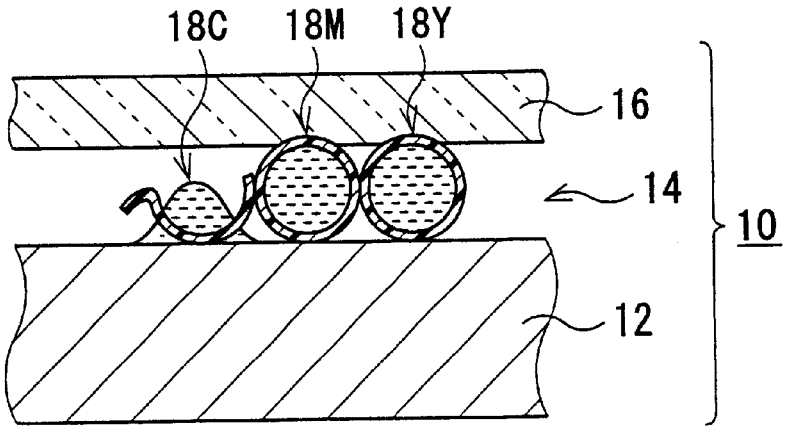
FIG. 5 is a schematic conceptual cross-sectional view similar to FIG. 1, showing only a selective breakage of a cyan microcapsule in the layer of microcapsules.

For example, if the selected heating temperature and breaking-pressure fall within a hatched cyan-developing area C (FIG. 3), defined by a temperature ranging between the glass-transition temperatures $T_1$ and $T_2$ and by a pressure ranging between the critical breaking-pressure $P_3$ and the upper limit pressure $P_{UL}$, only the cyan microcapsules 18C are squashed and broken, as representatively shown in FIG. 5. Also, if the selected heating temperature and breaking-pressure fall within a hatched magenta-developing area M, defined by a temperature ranging between the glass-transition temperatures $T_2$ and $T_3$ and by a pressure ranging between the critical breaking-pressures $P_2$ and $P_3$, only the magenta microcapsules 18M are squashed and broken. Further, if the selected heating temperature and breaking-pressure fall within a hatched yellow-developing area Y, defined by a temperature ranging between the glass-transition temperature $T_3$ and the upper limit temperature $T_{UL}$ and by a pressure ranging between the critical breaking-pressures $P_1$ and $P_2$, only the yellow microcapsules 18Y are squashed and broken.

Figure 6:
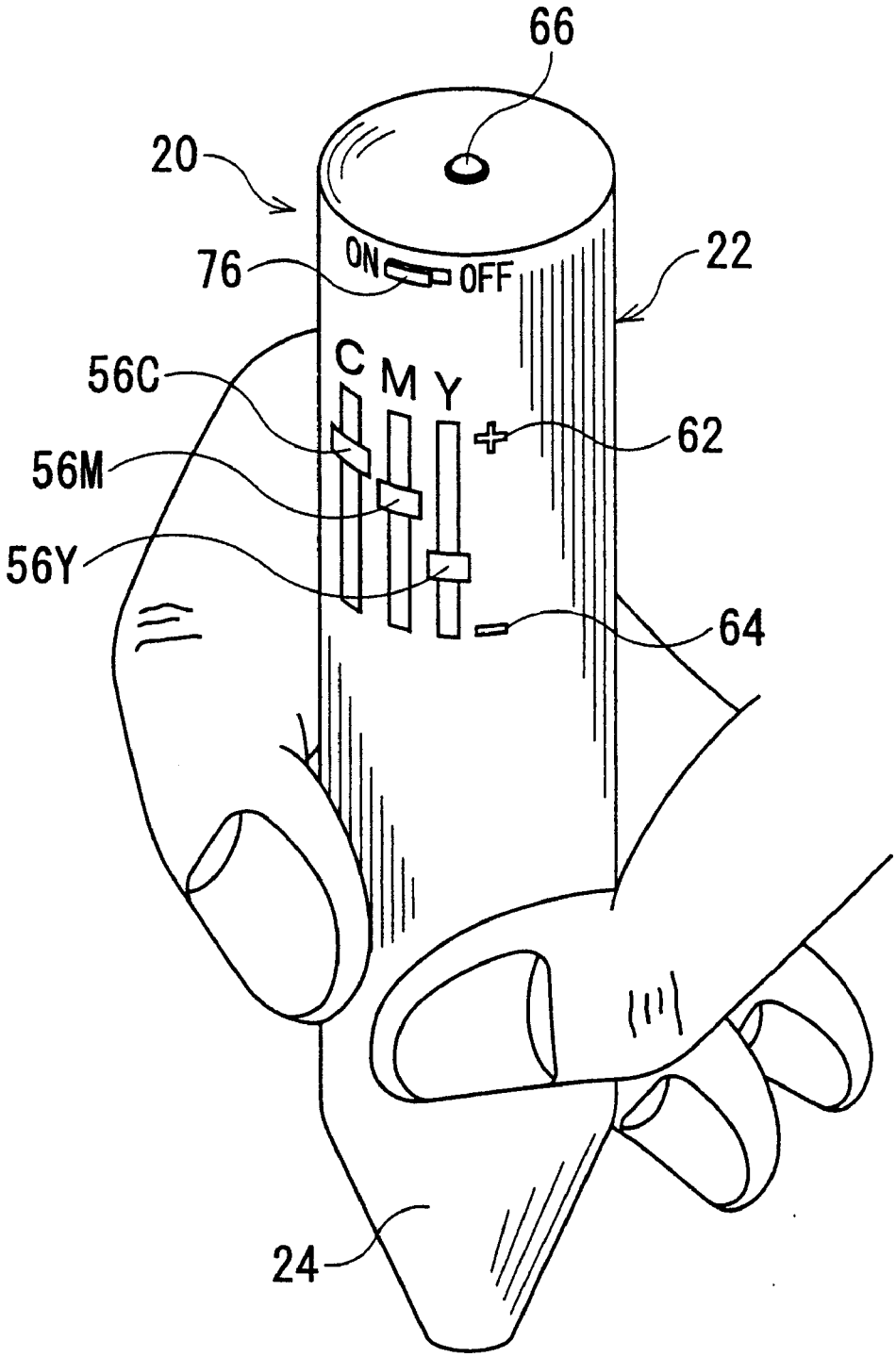
FIG. 6 is a schematic perspective view showing a pen pencil type thermal writing device, according to the present invention, which is provided with an end tip having a cyan heater element, a magenta heater element and a yellow element for forming cyan, magenta and yellow images, respectively, on the image-forming substrate shown in FIG. 1.
Figure 7:
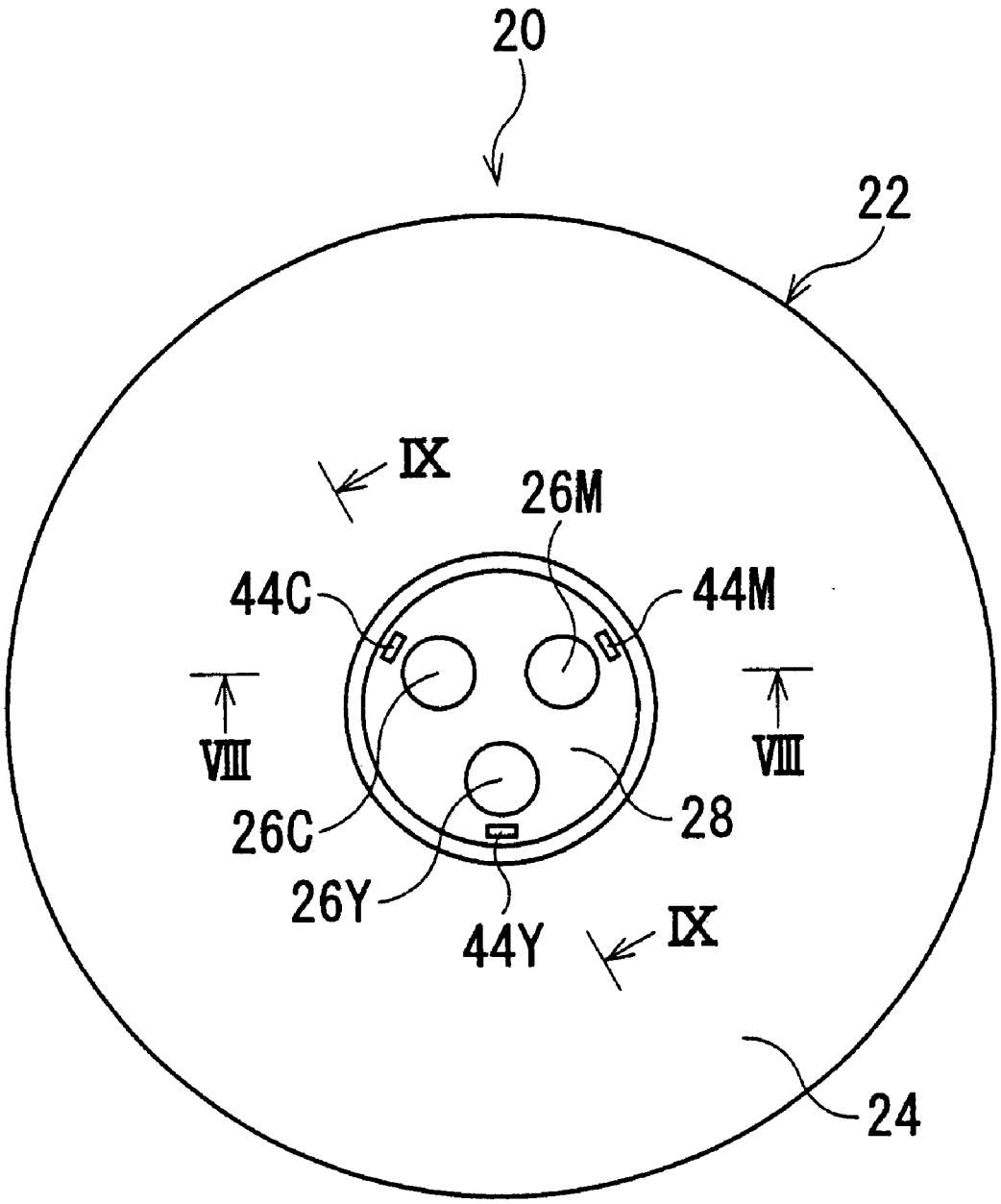
FIG. 7 is a tip-end view of the pen or pencil type thermal writing device of FIG. 6, showing an arrangement of the cyan, magenta and yellow heater elements thereof.

FIGS. 6 and 7 show a first embodiment of a manual thermal writing device according to the present invention, generally indicated by reference 20, by which a color image can be clearly and easily formed on the layer of microcapsules 14 of the image-forming sheet 10. As is apparent from FIG. 6, this manual thermal writing device 20 is constituted as a pen or pencil type of writing device.

The thermal writing device 20 comprises an elongated hollow body 22 formed of, for example, a suitable hard plastic material. The elongated hollow body 22 has a frustum-conical lower end portion 24 integrally formed therewith, and the end portion 24 features three electric resistance elements or heater elements 26C, 26M and 26Y (FIG. 7) provided at the tip-end face thereof. In particular, the heater elements 26C, 26M and 26Y are formed on a flexible circuit sheet 28 produced by using a photolithography, and are arranged such that three apexes of an equilateral triangle are represented by the three centers of the heater elements 26C, 26M and 26Y. Note, for example, each of the heater elements 26C, 26M and 26Y may have a diameter of 1 mm.

Figure 8:
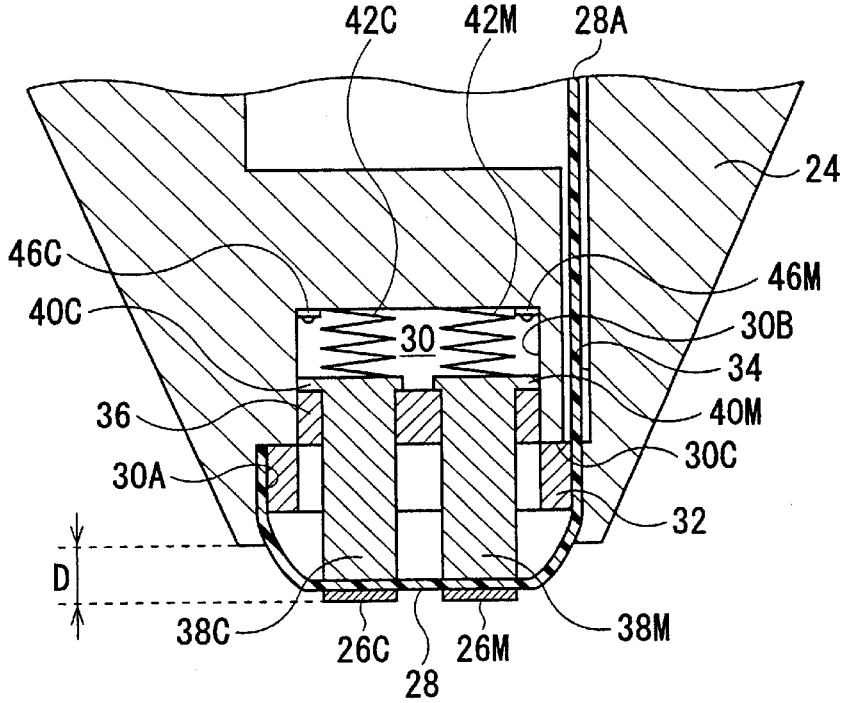
FIG. 8 is an enlarged partial cross-sectional view taken along a line VIII—VIII in FIG. 7.
Figure 9:
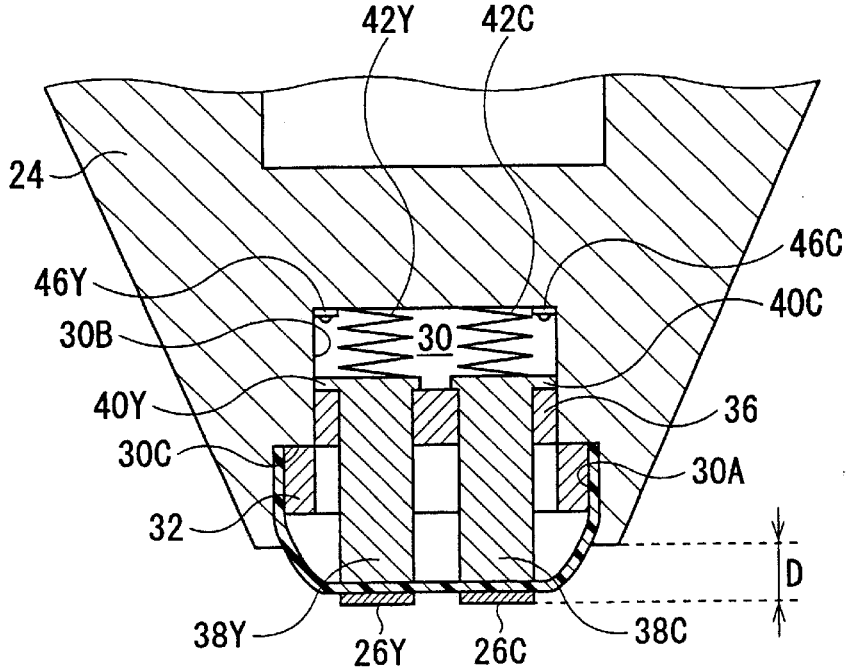
FIG. 9 is an enlarged partial cross-sectional view taken along a line IX—IX in FIG. 7.

As shown in FIGS. 8 and 9, being sections taken along lines VIII—VIII and IX—IX, respectively, in FIG. 7, the frustum-conical end portion 24 has a cylindrical recess 30 formed in the tip-end face thereof, and the recess 30 is offset so as to be divided into a large-diametrical recess section 30A and a small-diametrical recess section 30B, with an annular shoulder 30C being defined therebetween. A peripheral portion of the flexible circuit sheet 28 is received in the large-diametrical recess section 30A, and is securely fixed therein by an annular fastener ring element 32 inserted in the large-diametrical recess section 30A.

Also, as shown in FIG. 8, the flexible circuit sheet 28 is provided with a strip-like extension 28A integrally formed therewith. The strip-like extension 28A passes through a passage 34 formed in the frustum-conical end portion 24, and extends to a control circuit board (not shown) provided in the elongated body 22. Of course, although not illustrated, the flexible circuit sheet 28 with the strip-like extension 28A is provided with an electrical wiring pattern formed thereon, and the heater elements 26C, 26M and 26Y are electrically connected to the control circuit board through the electrical wiring pattern, whereby the heater elements 26C, 26M and 26Y are electrically energized in a manner as stated in detail hereinafter.

As shown in FIGS. 8 and 9, a plug member 36 is inserted in the small-diametrical recess section 30B, is securely fixed to a cylindrical inner wall thereof, and is formed with three bores in which three plunger elements 38C, 38M and 38Y are slidably inserted, respectively. The respective plunger elements 38C, 38M and 38Y have head portions 40C, 40M and 40Y integrally formed at an upper end thereof, and each of the head portions 40C, 40M and 40Y radially and outwardly extends so that the corresponding plunger element (38C, 38M, 38Y) cannot pass through the corresponding bore of the plug member 36.

The respective bores of the plug member 36 are arranged so as to be aligned with the heater elements 26C, 26M and 26Y, and each of the plunger elements 38C, 38M and 38Y has a same diameter as that of each heater element (26C, 26M, 26Y). Further, three springs elements 42C, 42M and 42Y; symbolically illusstrated in FIGS. 8 and 9, are received and constrained in the small-diametrical recess section 30B such that the respective spring elements 42C, 42M and 42Y act on the head portions 40C, 40M and 40Y, whereby the plunger elements 38C, 38M and 38Y are elastically and downwardly biased.

With the aforementioned arrangement, lower end faces of the plunger elements 38C, 38M and 38Y are engaged with an inner surface of the flexible circuit sheet 28 such that each of the heater elements 26C, 26M and 26Y is backed by the lower end face of the corresponding plunger element (38C, 38M, 38Y). Preferably, the lower end faces of the plunger elements 38C, 38M and 38Y are securely adhered to the inner surface of the flexible circuit sheet 28.

As shown in FIGS. 8 and 9, usually, the heater elements 26C, 26M and 26Y are at a distance D from the tip-end face of the frustum-conical end portion 24. When the pen-type manual writing device 20, gripped by a hand as shown in FIG. 6, is downwardly pressed against the microcapsule layer 14 of the image-forming sheet 10, the elongated body 22 is forced downward against the elastic forces of the spring elements 42C, and 42M and 42Y by the small distance D so that the tip end face of the frustum-conical end portion 24 comes into contact with the microcapsule layer 14. In other words, the heater elements 26C, 26M and 26Y are relatively moved with respect to the frustum-conical end portion 24 to a level defined by the tip-end face of the frustum-conical end portion 24.

In this case, the spring element 42C is selected such that the heater element 26C exerts a pressure between the critical breaking-pressure $P_3$ and the upper limit pressure $P_{UL}$ on the microcapsule layer 14, when at the level defined by the tip-end face of the frustum-conical end portion 24; the spring element 42M is selected such that the heater element 26M exerts a pressure between the critical breaking-pressures $P_2$ and $P_3$ on the microcapsule layer 14, when at the level defined by the tip-end face of the frustum-conical end portion 24; and the spring element 42Y is selected such that the heater element 26Y exerts a pressure between the critical breaking-pressures $P_1$ and $P_2$ on the microcapsule layer 14, when at the level defined by the tip-end face of the frustum-conical end portion 24.

As shown in FIG. 7, three thermistors 44C, 44M and 44Y are securely adhered to the flexible circuit sheet 28 adjacent to the respective heater elements 26C, 26M and 26Y, and a heating temperature of each heater element (26C, 26M, 26Y) is detected by the corresponding thermistor (44C, 44M, 44Y). Note, the thermistors 44C, 44M and 44Y are connected to the control circuit board, provided within the elongated body 22, through the electrical wiring pattern of the flexible circuit sheet 28 with the strip-like extension 28A.

As shown in FIGS. 8 and 9, three microswitches 46C, 46M and 46Y are securely attached to a bottom wall of the small-diametrical recess section 30B, and are associated with the plunger elements 38C, 38M and 38Y, respectively. In particular, when each of the heater elements 26C, 26M and 26Y is relatively moved to the level defined by the tip-end face of the frustum-conical end portion 24, the corresponding microswitch (46C, 46M, 46Y) is engaged with the head portion of the corresponding plunger element (38C, 38M, 38Y), thereby turning ON the corresponding microswitch (46C, 46M, 46Y). Note, the microswitches 46C, 46M and 46Y are electrically connected to the control circuit board, provided within the elongated body 22, through the electrical circuit pattern of the strip-like extension 28A.

Figure 10:
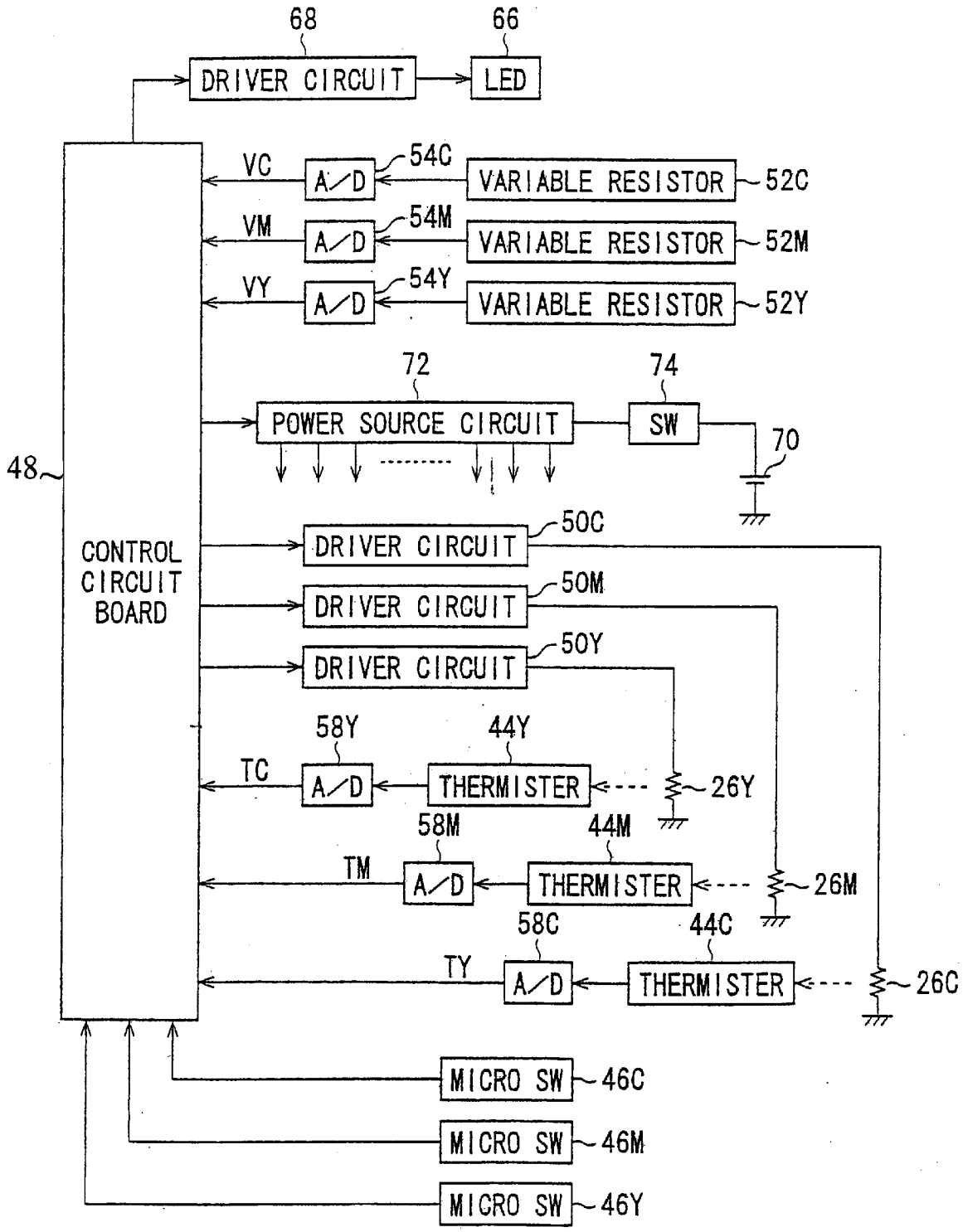
FIG. 10 is a schematic block diagram of the pen or pencil type thermal writing device shown in FIGS. 6 to 9.

FIG. 10 shows a schematic block diagram of the manual thermal writing device 20. In this block diagram, the control circuit board, provided in the elongated body 22, is indicated by reference 48, and comprises a microcomputer including a central processing unit (CPU), a read-only memory (ROM) for storing programs and constants, a random-access memory (RAM) for storing temporary data, and an input/output interface circuit (I/O).

In the block diagram of FIG. 10, references 50C, 50M and 50Y indicate three driver circuits for electrically energizing the heater elements 26C, 26M and 26Y, respectively, and the driver circuits 50C, 50M and 50Y are individually operated under control of the microcomputer of the control circuit board 48 such that each of the heater elements 26C, 26M and 26Y is heated to and kept at a manually-set temperature. For the manual-setting of a temperature to which each of the heater elements 26C, 26M and 26Y should be heated, the thermal writing device 20 includes three variable resistors provided in the elongated body 22. In FIG. 10, these respective variable resistors are indicated by references 52C, 52M and 52Y, and are connected to the control circuit board 24 via analog-to-digital (A/D) convertors 54C, 54M and 54Y.

The variable resistors 52C, 52M and 52Y are associated with manual-sliders 56C, 56M and 56Y, respectively, provided in a side wall of the elongated body 22 (FIG. 6), and an electrical resistance value of each variable resistor (52C, 52M, 52Y) varies by sliding and adjusting a corresponding manual-slider (56C, 56M, 56Y). Namely, each of the variable resistors 52C, 52M and 52Y outputs a voltage signal varying within a range between 0 volt and 5 volts in accordance with a variation in an electrical resistance value altered by a corresponding manual-slider (56C, 56M, 56Y). The output voltage signal is converted into a digital voltage data by a corresponding A/D convertor (54C, 54M, 54Y), and the digital voltage data is retrieved by the microcomputer of the control circuit board 48. In this microcomputer, the retrieved digital voltage data is converted into a temperature data in accordance with a one-dimensional map, previously stored in the ROM of the microcomputer.

Figure 11:
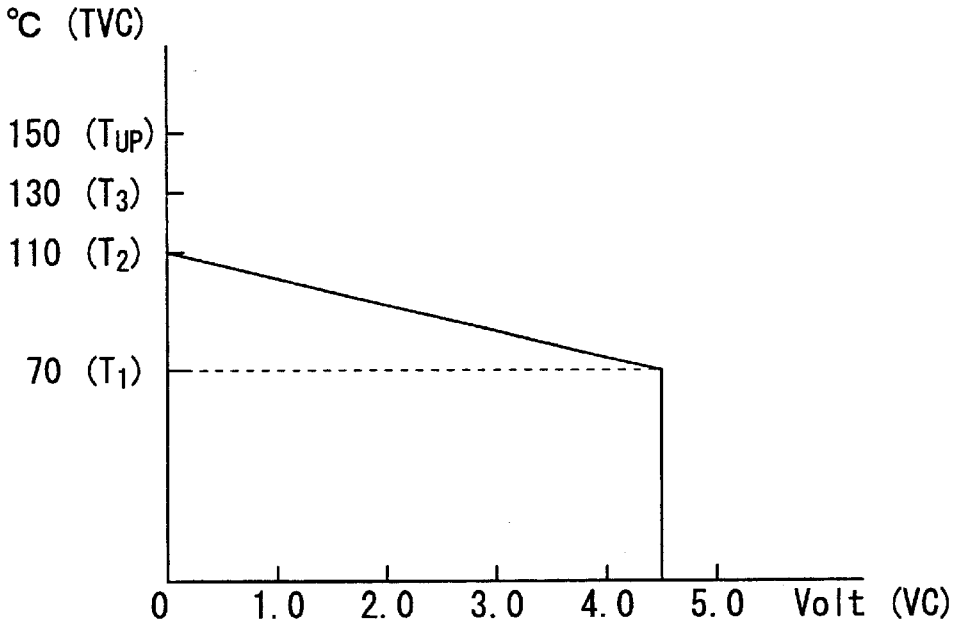
FIG. 11 is a graph representing a one-dimensional map for converting a voltage signal, output from a variable resister for adjusting a heating temperature of the cyan heater element, into a temperature data to which the cyan heater element should be heated.

For example, when the retrieved digital voltage data is derived from the variable resister 52C, the conversion of the voltage data into the temperature data is performed in accordance with a one-dimensional map represented by a graph of FIG. 11. Note, in this graph, the retrieved voltage data and the converted temperature data are designated by references VC and TVC, respectively.

When the voltage data VC falls in a range between 4.5 volts and 5.0 volts, the conversion of the voltage data VC into the temperature data TVC is not performed, and then the driver circuit 50C is not operated so that the heater element 26C is not electrically energized.

As is apparent from the graph of FIG. 11, when the voltage data VC falls in a range between 0 volts and 4.5 volts, converted to a temperature data TVC within a range between 70° C. and 110° C. occurs, and then the driver circuit 50C is operated so that the heater element 26C is electrically energized to be heated to and kept at a temperature corresponding to the converted temperature data TVC. To this end, a heating temperature of the heater element 26C is detected by the thermistor 44C, and the detected heating temperature is converted into a heating temperature data TC by an analog-to-digital (A/D) convertor 58C, and is then retrieved by the microcomputer of the control circuit board 48. In short, the electrical energization of the heater element 26C is controlled by the driver circuit 50C, such that the detected heating temperature data TC coincides with the temperature data TVC.

Figure 12:
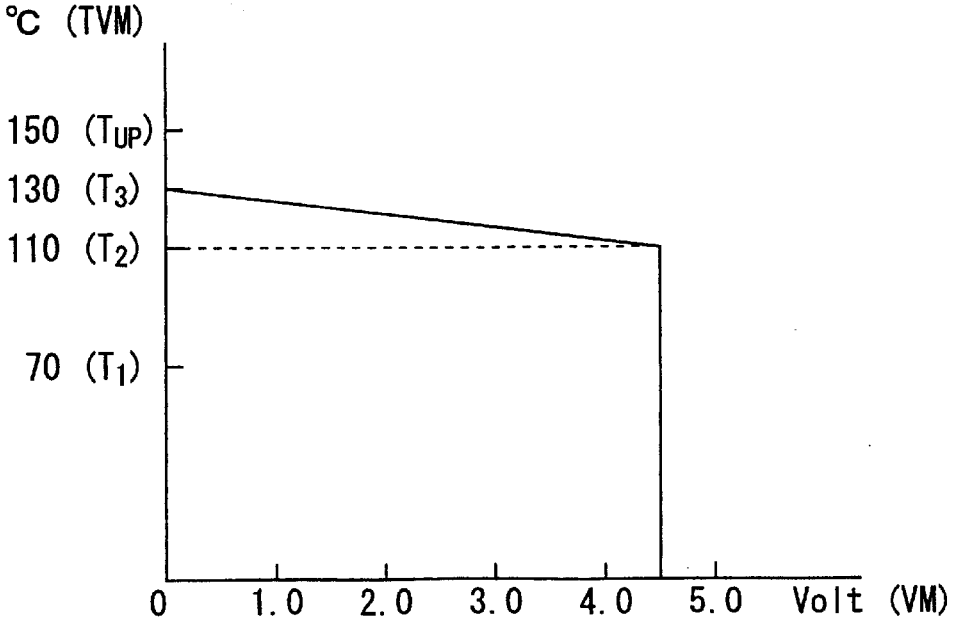
FIG. 12 is a graph representing a one-dimensional map for converting a voltage signal, output from a variable resister for adjusting a heating temperature of the magenta heater element, into a temperature data to which the magenta heater element should be heated.

Also, when the retrieved digital voltage data is derived from the variable resister 52M, the conversion of the voltage data into the temperature data is performed in accordance with a one-dimensional map represented by a graph of FIG. 12. Note, in this graph, the retrieved voltage data and the converted temperature data are designated by references VM and TVM, respectively.

Similar to the above case, when the voltage data VM falls in a range between 4.5 volts and 5.0 volts, the conversion of the voltage data VM into the temperature data TVM is not performed, and then the driver circuit 50M is not operated so that the heater element 26M is not electrically energized.

As is apparent from the graph of FIG. 12, when the voltage data VM falls in a ranging between 0 volts and 4.5 volts, conversion to a temperature data TVM within a range between 110° C. and 130° C. occurs, and then the driver circuit 50M is operated so that the heater element 26M is electrically energized to be heated to and kept at a temperature corresponding to the converted temperature data TVM. To this end, a heating temperature of the heater element 26M is detected by the thermistor 44M, and the detected heating temperature is converted into a heating temperature data TM by an analog-to-digital (A/D) convertor 58M, and is then retrieved by the microcomputer of the control circuit board 48. In short, the electrical energization of the heater element 26M is controlled by the driver circuit 50M, such that the detected heating temperature data TM coincides with the temperature data TVM.

Figure 13:
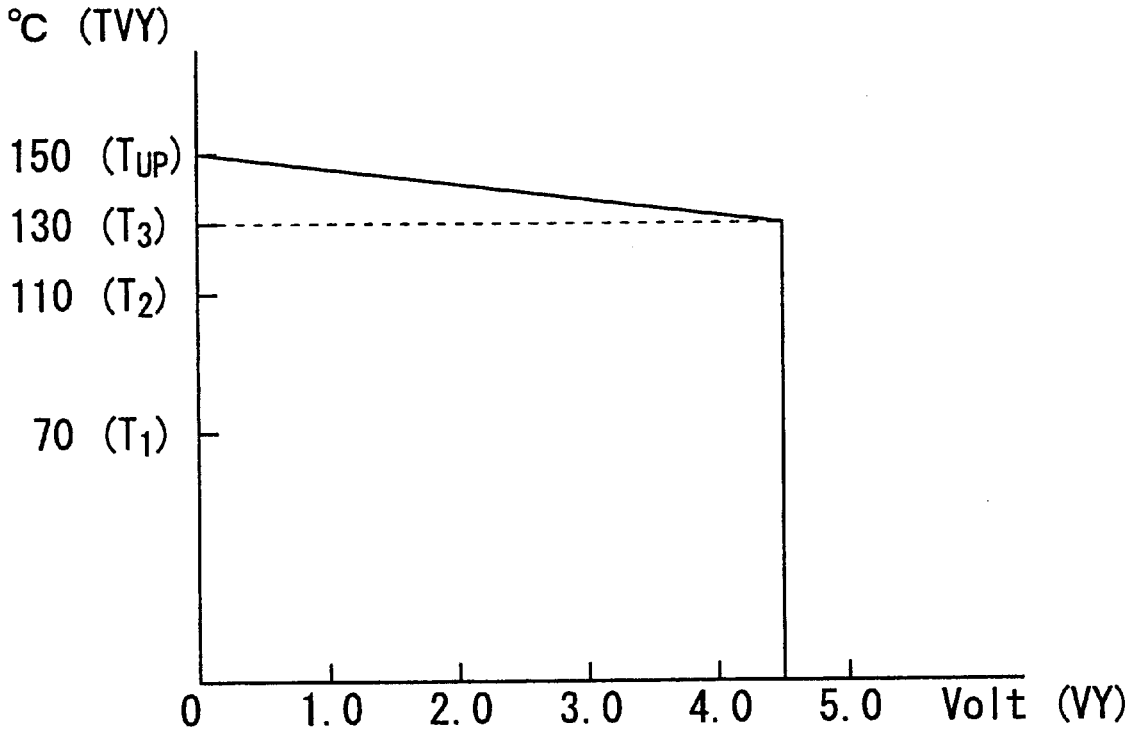
FIG. 13 is a graph representing a one-dimensional map for converting a voltage signal, output from a variable resister for adjusting a heating temperature of the yellow heater element, into a temperature data to which the yellow heater element should be heated.

Further, when the retrieved digital voltage data is derived from the variable resister 52Y, the conversion of the voltage data into the temperature data is performed in accordance with a one-dimensional map represented by a graph of FIG. 13. Note, in this graph, the retrieved voltage data and the converted temperature data are designated by references VY and TVY, respectively.

Similar to the above cases, when the voltage data VY falls in a range between 4.5 volts and 5.0 volts, the conversion of the voltage data VY into the temperature data TVY is not performed, and then the driver circuit 50Y is not operated so that the heater element 26Y is not electrically energized.

As is apparent from the graph of FIG. 13, when the voltage data VY falls in a range between 0 volts and 4.5 volts, conversion to a temperature data TVY within a range between 130° C. and 150° C., and then the driver circuit 50Y is operated so that the heater element 26Y is electrically energized to be heated to and kept at a temperature corresponding to the converted temperature data TVY. To this end, a heating temperature of the heater element 26Y is detected by the thermistor 44Y, and the detected heating temperature is converted into a heating temperature data TY by an analog-to-digital (A/D) convertor 58Y, and is then retrieved by the microcomputer of the control circuit board 48. In short, the electrical energization of the heater element 26Y is controlled by the driver circuit 50Y, such that the detected heating temperature data TY coincides with the temperature data TVY.

As shown in FIG. 6, a plus symbol 62 and a minus symbol 64 are affixed at both terminals of a sliding range along which each of the manual-sliders 56C, 56M and 56Y is slid. As each of the manual-sliders 56C, 56M and 56Y is slid and adjusted toward a plus end side designated by the plus symbol 62, a voltage value of a voltage data (VC, VM, VY), derived from a corresponding variable resistor (52C, 52M, 52Y), becomes lower, resulting in rise in a converted temperature data (TVC, TVM, TVY), and vice versa.

As mentioned above, since each of the heater element 26C, 26M and 26Y cannot be electrically energized as long as a corresponding manual-slider (56C, 56M, 56Y) is at an adjusted position corresponding to the range between 4.5 volts and 5.0 volts, it is possible to prevent unaware and unexpected electrical energization of a heater element (26C, 26M, 26Y). Namely, if each of the heater element 26C, 26M and 26Y cannot be electrically energized only when a corresponding manual-slider (56C, 56M, 56Y) is at a minus end side designated by the minus symbol 64, electrical energization of the heater element concerned may unexpectedly occur due to an accidental movement of the corresponding manual-slider.

As shown in FIG. 10, the microswitches 46C, 46M and 46Y are connected to the microcomputer of the control circuit board 48. Each of the microswitches 46C, 46M and 46Y produces an ON-signal when being turned ON by a head portion (40C, 40M, 40Y) of a corresponding plunger element (38C, 38M, 38Y), and the produced ON-signal is retrieved by the microcomputer of the control circuit board 48. On the other hand, the thermal writing device 20 is provided with an LED (light emitting diode) 66 provided in a top wall of the elongated body 22, as shown in FIG. 6, and the LED 66 is electrically energized and lit by a driver circuit 68 (FIG. 10), operated under control of the microcomputer of the control circuit board 48, when all of the microswitches 46C, 46M and 46Y are turned ON. As stated in detail hereinafter, the electrical energization of the heater elements 26C, 26M and 26Y cannot be performed until the LED 66 is lit.

The thermal writing device 20 contains a battery, designated by reference 70 in FIG. 10, which is exchangeably provided in the elongated body 22, and various electronic elements, as shown in FIG. 10, are supplied with electric power through a power source circuit 72, operated under control of the microcomputer of the control circuit board 48. A power ON/OFF switch 74 is interposed between the battery 70 and the power source circuit 72, and a turning-ON and a turning-OFF of the power ON/OFF switch 74 is manually performed by an ON/OFF slider 76 (FIG. 6) provided on a top side wall of the elongated body 22.

Figure 14:
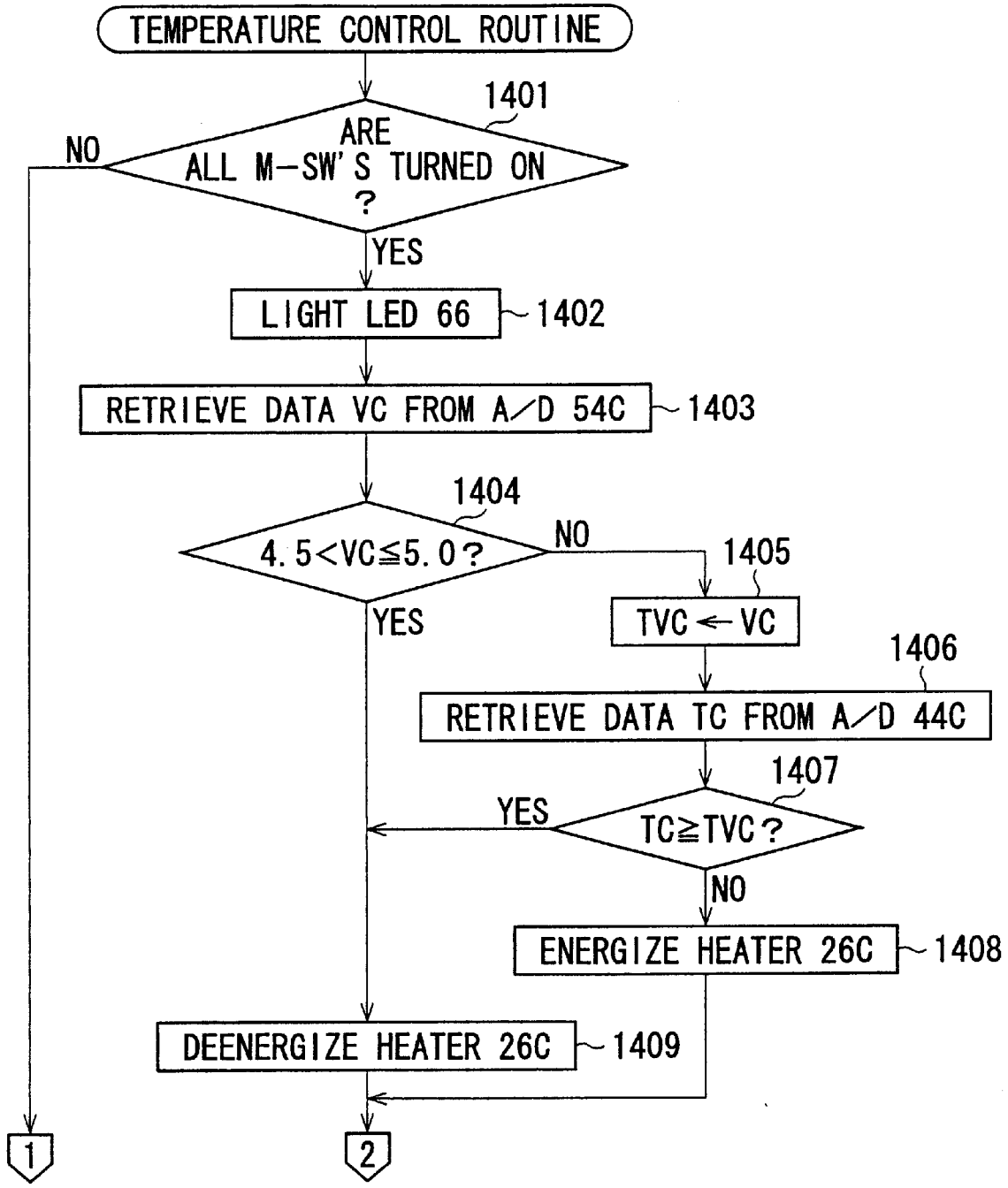
FIG. 14 is a part of a flowchart of a temperature control routine, executed in a microcomputer of a control circuit board shown in FIG. 10, for controlling an electrical energization of the cyan, magenta and yellow heater elements of the pen or pencil type thermal writing device.
Figure 15:
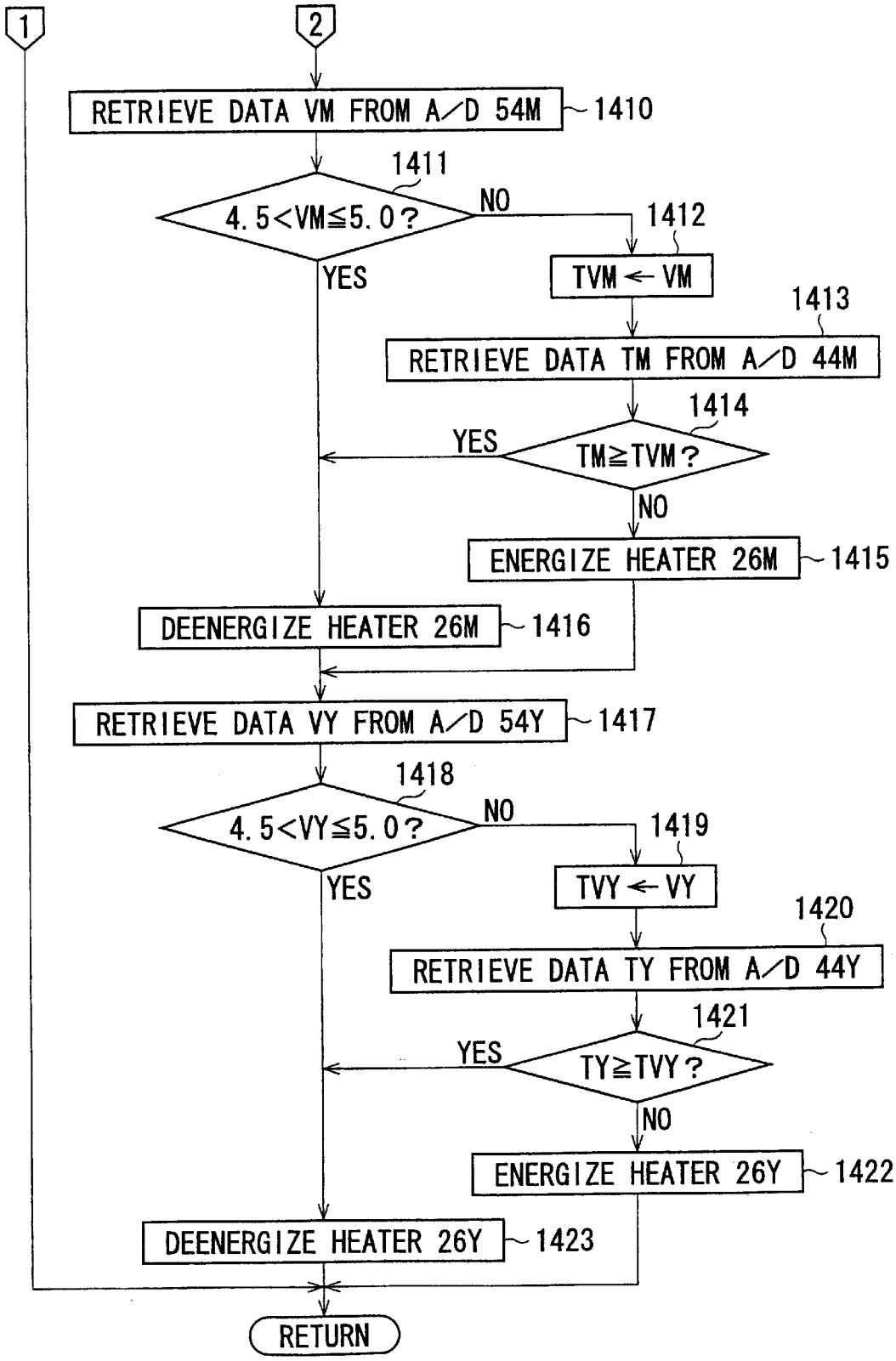
FIG. 15 is the remaining part of the flowchart of the temperature control routine referred to in FIG. 14.

FIGS. 14 and 15 show a flowchart of a temperature control routine, executed by the microcomputer of the control circuit board 48, by which the electrical energizations of the heater elements 26C, 26M and 26Y are controlled. This temperature control routine is constituted as a time-interruption routine, which is repeatedly executed at regular interval of, for example, 100 $\mu$sec, and the execution of this routine is started when the power ON/OFF switch 74 is turned ON.

At step 1401, it is determined whether all of the microswitches 46C, 46M and 46Y are turned ON. If one of the microswitches 46C, 46M and 46Y is not turned ON, the routine once ends. Although the routine is repeatedly executed at regular interval of 100 $\mu$sec, there is no progress until all of the microswitches 46C, 46M and 46Y are turned ON.

Of course, when the gripped manual writing device 20 (FIG. 6), is downwardly pressed against the microcapsule layer 14 of the image-forming sheet 10 so that the tip-end face of the frustum-conical end portion 24 comes into contact with the microcapsule layer 14, all of the microswitches 46C, 46M and 46Y are turned ON. Namely, at step 1401, it is determined whether this situation is produced.

When the turning-ON of all the microswitches 46C, 46M and 46Y is confirmed, the control proceeds from step 1401 to step 1402, in which the LED 66 is lit, thereby indicating to a user that an image can be drawn on the microcapsule layer 14 of the image-forming sheet 10 by the thermal writing device 20. Then, at step 1403, a voltage data VC is retrieved from the A/D converter 54C. As is apparent from the foregoing, a voltage value of the retrieved voltage data VC is derived from a manual-setting of the manual-slider 56C.

At step 1404, it is determined whether the retrieved voltage VC falls in a range between 4.5 volts and 5.0 volts. If VC≦4.5 volts, the control proceeds to step 1405, in which the retrieved voltage data VC is converted into a temperature data TVC in accordance with the one-dimensional map previously stored in the ROM and represented by the graph of FIG. 11.

At step 1406, a heating temperature data TC, which is derived from a heating temperature of the heater element 36C detected by the thermistor 44C, is retrieved from the A/D converter 58C. Then, at step 1407, it is determined whether the heating temperature data TC is equal to or exceeds the converted temperature data TVC. If TC<TVC, the control proceeds to step 1408, in which the driver circuit 50C is operated so that the heater element 26C is electrically energized. On the other hand, if TC≧TVC, the control proceeds from step 1407 to step 1409, in which the heater element 26C is electrically deenergized.

Note, at step 1404, if the retrieved voltage VC falls in a range between 4.5 volts and 5.0 volts, the control directly proceeds from step 1404 to step 1409. Of course, in this case, the electrical energization of the heater element 26C cannot be performed.

At step 1410, a voltage data VM, a voltage value of which is derived from a manual-setting of the manual-slider 56M, is retrieved from the A/D converter 54M. At step 1411, it is determined whether the retrieved voltage VM falls in a range between 4.5 volts and 5.0 volts. If VM≦4.5 volts, the control proceeds to step 1412, in which the retrieved voltage data VM is converted into a temperature data TVM in accordance with the one-dimensional map previously stored in the ROM and represented by the graph of FIG. 12.

At step 1413, a heating temperature data TM, which is derived from a heating temperature of the heater element 26M detected by the thermistor 44M, is retrieved from the A/D converter 58M. Then, at step 1414, it is determined whether the heating temperature data TM is equal to or exceeds the converted temperature data TVM. If TM<TVM, the control proceeds to step 1415, in which the driver circuit 50M is operated so that the heater element 26M is electrically energized. On the other hand, if TM≧TVM, the control proceeds from step 1414 to step 1416, in which the heater element 26M is electrically deenergized.

Note, at step 1411, if the retrieved voltage VM falls in a range between 4.5 volts and 5.0 volts, the control directly proceeds from step 1411 to step 1416. Of course, in this case, the electrical energization of the heater element 26M cannot be performed.

At step 1417, a voltage data VY, a voltage value of which is derived from a manual-setting of the manual-slider 56Y, is retrieved from the A/D converter 54Y. At step 1418, it is determined whether the retrieved voltage VY falls in a range between 4.5 volts and 5.0 volts. If VY≦4.5 volts, the control proceeds to step 1419, in which the retrieved voltage data VY is converted into a temperature data TVY in accordance with the one-dimensional map previously stored in the ROM and represented by the graph of FIG. 13.

At step 1420, a heating temperature data TY, which is derived from a heating temperature of the heater element 26Y detected by the thermistor 44Y, is retrieved from the A/D converter 58Y. Then, at step 1421, it is determined whether the heating temperature data TY is equal to or exceeds the converted temperature data TVY. If TY<TVY, the control proceeds to step 1422, in which the driver circuit 50Y is operated so that the heater element 26Y is electrically energized. On the other hand, if TY24 TVY, the control proceeds from step 1421 to step 1423, in which the heater element 26Y is electrically deenergized.

Note, at step 1418, if the retrieved voltage VY falls in a range between 4.5 volts and 5.0 volts, the control directly proceeds from step 1418 to step 1423. Of course, in this case, the electrical energization of the heater element 26Y cannot be performed.

Accordingly, for example, if only the heater element 26C is electrically energized, a cyan line can be drawn on the microcapsule layer 14 of the image-forming sheet 10 by depressedly moving the pen-type thermal writing device 20 on the microcapsule layer 14. Of course, by only electrically energizing the heater element 26M, a magenta line can be drawn, and, by only electrically energizing the heater element 26Y, a yellow line can be drawn. Also, it is possible to draw one of red, green and blue lines by electrically energizing two of the heater elements 26C, 26M and 26Y. Of course, when all of the heater elements 26C, 26M and 26y are electrically energized, a black line can be drawn.

Further, since a heating temperature of a heater element (26C, 26M, 26Y) is variable within a given temperature range, as shown in each of FIGS. 11, 12 and 13, it is possible to adjust a density of a drawn color line.

In the aforementioned first embodiment, although the three respective microswitches 46C, 46M and 46Y are associated with the plunger elements 38C, 38M and 38Y, it is possible to use only one microswitch associated with either the plunger element 38C, 38M or 38Y.

Figure 16:
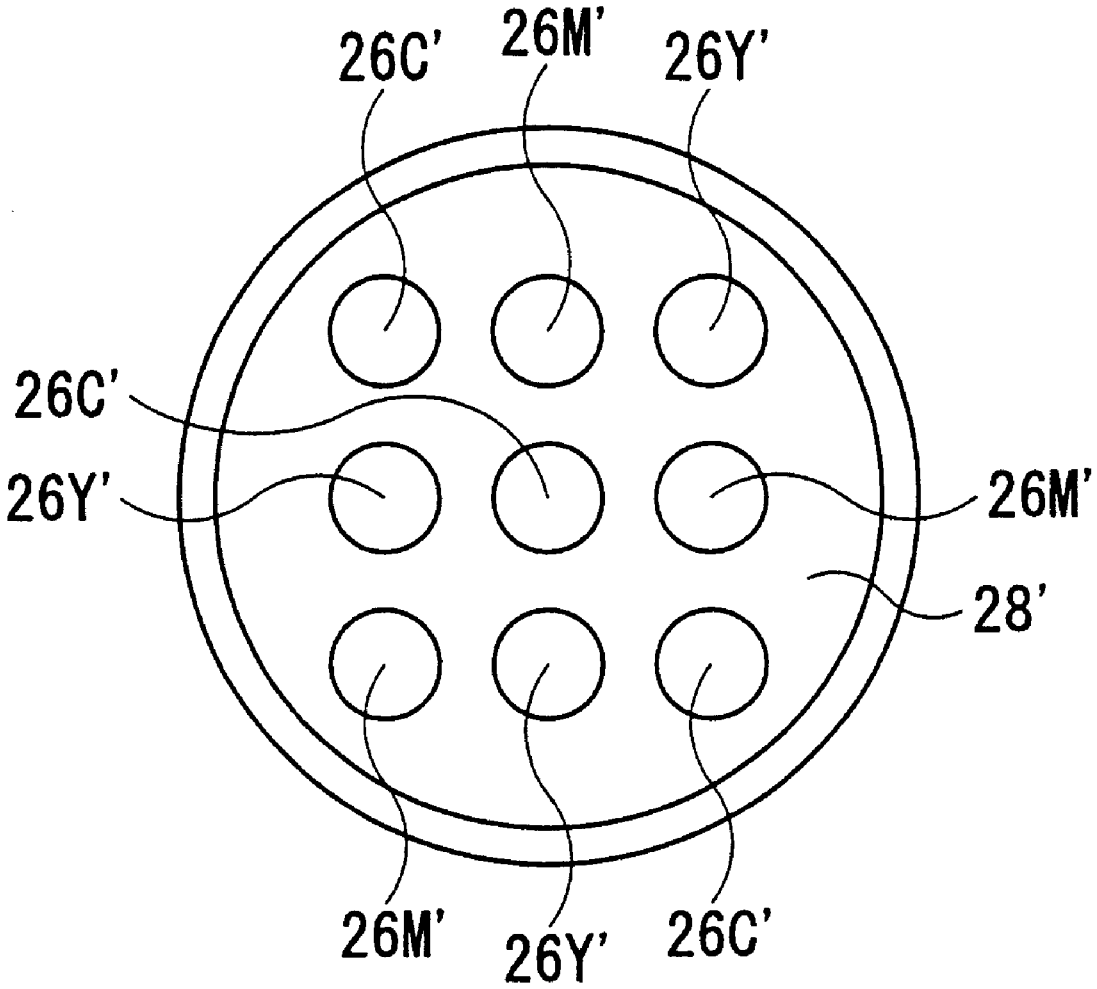
FIG. 16 is a tip-end view of the pen or pencil type thermal writing device, showing another arrangement of cyan heater elements, magenta heater elements and yellow heater elements provided thereon.

Also, in the first embodiment, a number of heater elements (26C, 26M and 26Y) may be more than three, although preferably should be a multiple of three. For example, as shown in FIG. 16, nine heater elements 26C', 26M' and 26Y' may be arranged in a 3×3 matrix configuration on a flexible circuit sheet 28'. Of course, in use, the three heater elements 26C' are pressed against the microcapsule layer 14 at a pressure ranging between the critical breaking-pressure $P_3$ and the upper limit pressure $P_{UL}$, and are electrically energized in the same manner as the heater element 26C; the three heater elements 26M' are pressed against the microcapsule layer 14 at a pressure ranging between the critical breaking-pressures $P_2$ and $P_3$, and are electrically energized in the same manner as the heater element 26M; and the three heater elements 26Y' are pressed against the microcapsule layer 14 at a pressure ranging between the critical breaking-pressures $P_1$ and $P_2$, and are electrically energized in the same manner as the heater element 26Y.

Figure 17:
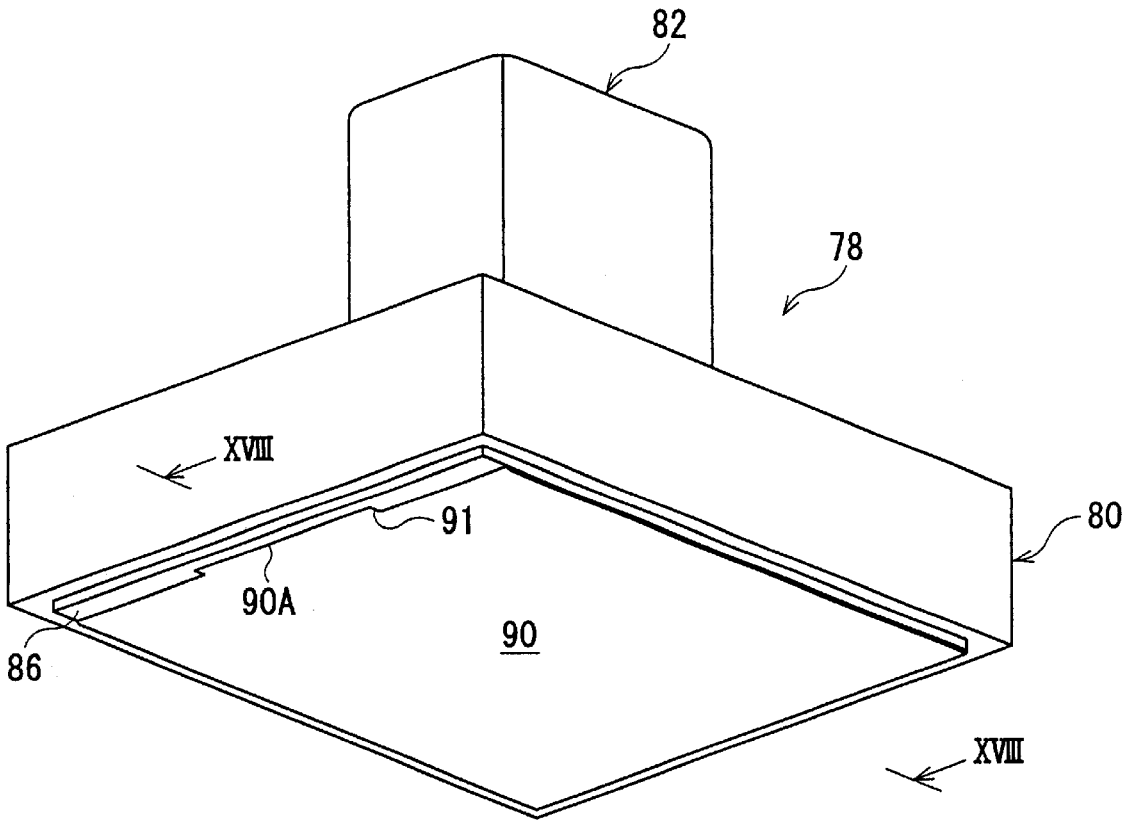
FIG. 17 is a schematic perspective view showing a stamp-type thermal writing device, according to the present invention, which is provided with cyan heater elements, magenta heater elements and yellow heater elements, arranged on a stamping surface thereof, for forming a color image on the image-forming substrate shown in FIG. 1.
Figure 18:
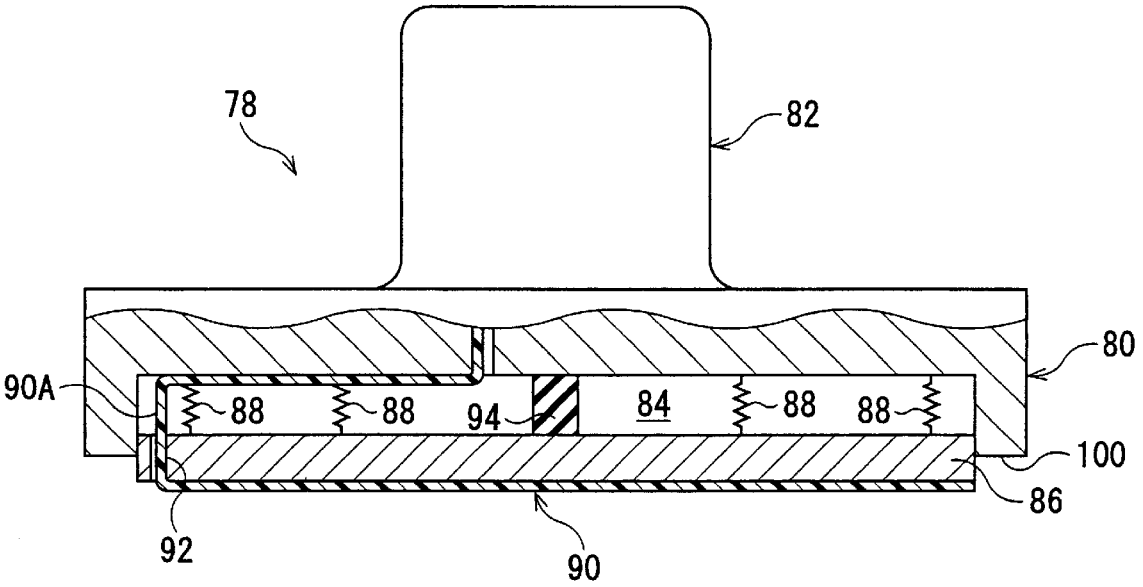
FIG. 18 is a partial cross-sectional view taken along a line XVIII—XVIII in FIG. 17.

FIGS. 17 and 18 show a second embodiment of the manual thermal writing device according to the present invention, generally indicated by reference 78, by which a color image can be clearly and easily formed on the layer of microcapsules 14 of the image-forming sheet 10. As is apparent from FIG. 17, this manual thermal writing device 78 is constituted as a stamp-type of writing device.

The writing device 78 comprises a box-like body 80 having a hollow grip 82 securely attached to a central area of a top wall thereof, and the box-like body 80 and the hollow grip 82 are formed of, for example, a suitable hard plastic material. As best shown in FIG. 18, being a section taken along a line XVIII—XVIII in FIG. 17, the box-like body 80 is formed with a rectangular recess 84 in a bottom thereof, and a rigid rectangular plate member 86 is movably received in the rectangular recess 84. Namely, plural spring elements 88, symbolically illustrated in FIG. 18, are provided between the bottom of the recess 84 and the rigid plate member 86, such that the rigid plate member 86 is suspended from the spring elements 88.

As shown in FIGS. 17 and 18, a rectangular flexible circuit sheet 90, produced by using a photolithography, is securely adhered to a lower surface of the rigid plate member 86, and is provided with a strip-like extension 90A integrally formed therewith. The strip-like extension 90A passes through a slot 91 formed along a side of the rigid plate member 86, and extends to a control circuit board (not shown) provided in the hollow grip 82.

Figure 19:
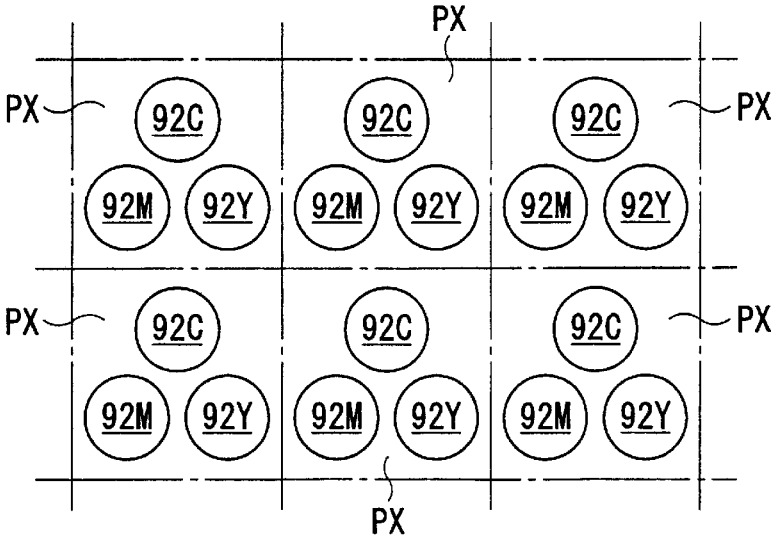
FIG. 19 is a partial conceptual view showing the arrangement of the cyan, magenta and yellow heater elements of the stamp-type thermal writing device.

As partially shown in FIG. 19, the flexible circuit sheet 90 is provided with three types of electric resistance elements or heater elements: a first type of heater element 92C; a second type of heater element 92M; and a third type of heater element 92Y, formed on an outer surface thereof, and these types of heater elements 92C, 92M and 92Y are regularly arranged.

In particular, a set of three heater elements 92C, 92M and 92Y is arranged such that three apexes of an equilateral triangle are represented by the three centers of the heater elements 92C, 92M and 92Y in each set, and the set defines a one-pixel area PX, delimited by single-dot lines in FIG. 19, for forming a color image on the microcapsule layer 14 of the image-forming sheet 10, as stated in detail hereinafter. Note, for example, the one-pixel area PX has a size of 1 $mm^2$.

Of course, although not shown, the flexible circuit sheet 90 with the strip-like extension 90A is provided with an electrical wiring pattern formed thereon, and the three types of heater elements 92C, 92M and 92Y are electrically connected to the control circuit board, provided in the hollow grip 82, through the electrical wiring pattern, whereby the respective types of heater elements 92C, 92M and 92Y are selectively and electrically energized in accordance with digital color image signals: digital cyan image-pixel signals; digital magenta image-pixel signals; and digital yellow image-pixel signals, in a manner as stated in detail hereinafter.

The stamp-type thermal writing device 78 is provided with a rubber block element 94 disposed between the bottom surface of the recess 84 and the rigid plate member 86 at a centeral area thereof, and a strain gauge 98 (FIG. 20) is attached to the rubber block element 94. When the thermal writing device 78 is pressed against the microcapsule layer 14 of the image-forming sheet 10, the strain gauge 98 detects a pressure exerted by the rigid plate member 86 on the microcapsule layer 14.

In particular, as best shown in FIG. 18, usually, the rigid plate member 86 is partially projected from an opening of the recess 84, defined by a bottom surface peripheral edge face 100 of the box-like body 80. Thus, when the thermal writing device 78 is pressed against the microcapsule layer 14 of the image-forming sheet 10, the rigid plate member 86 is depressed in the recess 84 so that the spring elements 88 are compressed, resulting in a pressure being uniformly exerted by the rigid plate member 86 on the microcapsule layer 14 due to the compressed spring elements 88.

In this second embodiment, the arrangement of the spring elements 88 is constituted such that a pressure, exerted by the rigid plate member 86 on the microcapsule layer 14, reaches 20 MPa ($P_{UL}$) when the depression of the rigid plate member 86 is carried out until the peripheral edge face 100 of the box-like body 80 comes in contact with the microcapsule layer 14.

Figure 20:
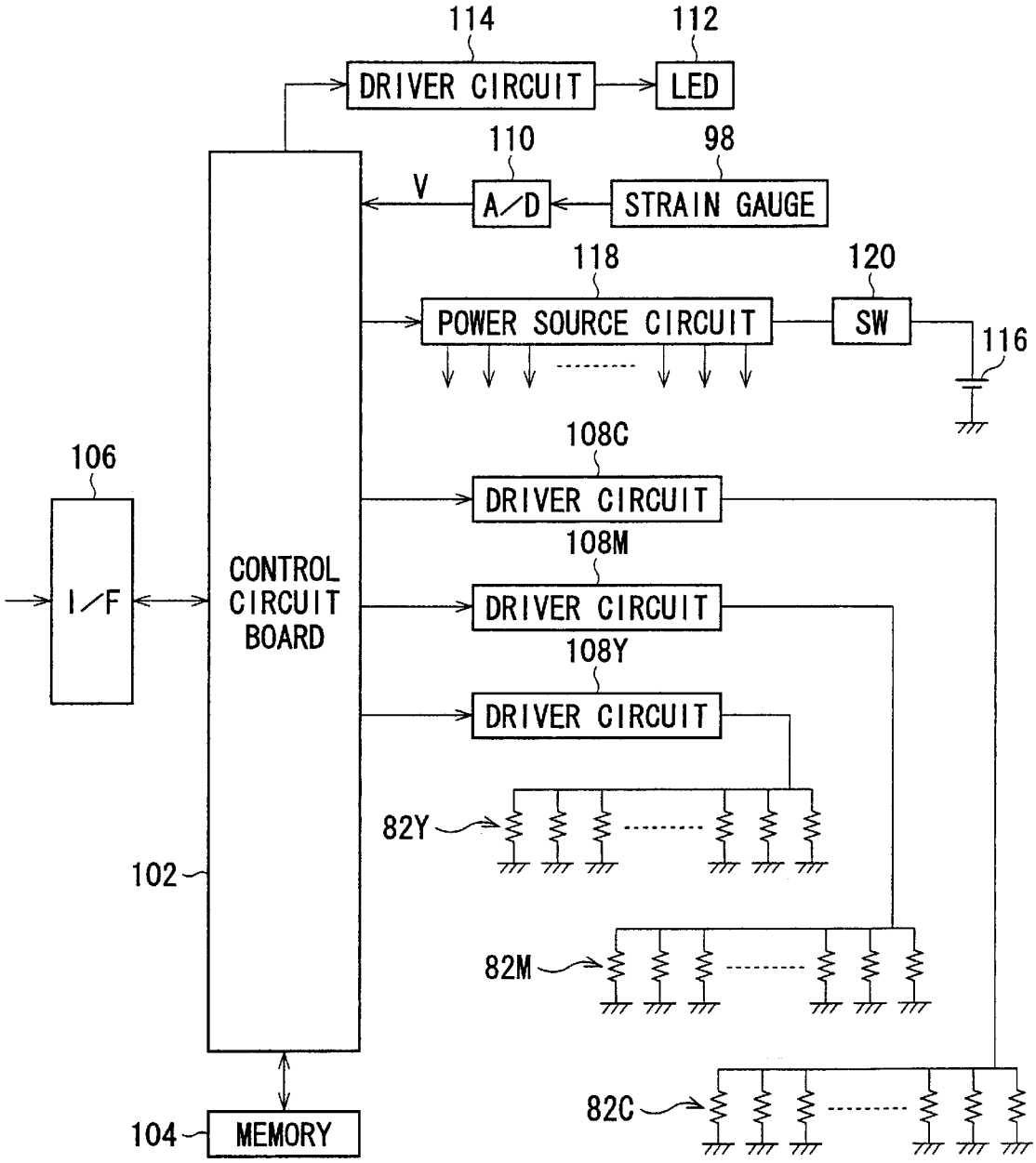
FIG. 20 is a schematic block diagram of the stamp-type thermal writing device shown in FIGS. 17 to 19.

FIG. 20 shows a schematic block diagram of the stamp-type thermal writing device 78. In this block diagram, the circuit control board, provided in the hollow grip 82, is indicated by reference 102, and comprises a microcomputer including a central processing unit (CPU), a read-only memory (ROM) for storing programs and constants, a random-access memory (RAM) for storing temporary data, and an input/output interface circuit (I/O).

The control circuit board 102 is provided with a frame memory 104 for storing a frame of digital color image-pixel signal: a frame of digital cyan image-pixel signals; a frame of digital magenta image-pixel signals; and a frame of digital yellow image-pixel signals, on which a color image to be recorded by the stamp-type thermal writing device 78 is based. Preferably, the control circuit board 102 is provided with an interface circuit (I/F) 106, through which the control circuit board 102 is connectable to a personal computer or a word processor (not shown) through the interface circuit 106, whereby a color image to be recorded by the stamp-type thermal writing device 78 is changeable, if necessary.

In particular, a color image to be recorded by the stamp-type thermal writing device 78 is produced by the personal computer or the word processor. Then, the produced color image is fed as a frame of digital color image-pixel signals to the control circuit board 102 through the interface circuit (I/F) 106, and the frame of digital color image-pixel signals is stored in the frame memory 104.

In the block diagram of FIG. 20, references 108C, 108M and 108Y indicate three driver circuits for selectively and electrically energizing the first, second and third types of heater elements 82C, 82M and 82Y, respectively, and the driver circuits 108C, 108M and 108Y are individually operated under control of the microcomputer of the control circuit board 102. By operating the driver circuit 108C, the heater elements 82C are selectively and electrically energized in accordance with the frame of digital cyan image-pixel signals. Also, by operating the driver circuit 108M, the heater elements 82M are selectively and electrically energized in accordance with the frame of digital magenta image-pixel signals. Similarly, by operating the driver circuit 108Y, the heater elements 82Y are selectively and electrically energized in accordance with the frame of digital yellow image-pixel signals.

The selective and electrical energization of the heater elements (82C, 82M, 82Y) may be performed in substantially the same manner as plural heater elements of a conventional thermal printer head thermal, being selectively and electrically energized in accordance with digital image-pixel signals. Namely, when a digital monochromatic image-pixel signal has a value of "1", a corresponding heater element (82C, 82M, 82Y) is electrically energized over a predetermined time period, and, when a digital monochromatic image-pixel signal has a value of "0", a corresponding heater element (82C, 82M, 82Y) cannot be electrically energized.

The strain gauge 98 is connected to the microcomputer of the control circuit board 102 via an analog-to-digital (A/D) converter 110. When the strain gauge 98 detects a pressure exerted by the rigid plate member 86 on the microcapsule layer 14 of the image-forming sheet 10, it outputs a voltage signal exhibiting a voltage value according to a magnitude of the exerted pressure. The outputted voltage signal is converted into a digital voltage data V by the A/D converter 110, and the digital voltage data V is retrieved by the microcomputer of the control circuit board 102.

In the block diagram of FIG. 20, reference 112 indicates an LED (light emitting diode) provided at a suitable location on a top wall of the box-like body 80, and the LED 112 is electrically energized and lit by a driver circuit 114, operated under control of the microcomputer of the control circuit board 102, when the strain gauge 98 detects 20 MPa of pressure being exerted by the rigid plate member 86 on the microcapsule layer 14.

The stamp-type thermal writing device 78 contains a battery, designated by reference 116 in FIG. 20, which is exchangeably provided in the hollow grip 82, and various electronic elements, as shown in FIG. 20, are supplied with electric power through a power source circuit 118, operated under control of the microcomputer of the control circuit board 102. A power ON/OFF switch 120 is interposed between the battery 116 and the power source circuit 118, and may be provided at a suitable location on a side wall of the box-like body 80. A turning-ON and a turning-OFF of the power ON/OFF switch 120 is manually performed.

By using the aforementioned stamp-type thermal writing device 78, a color image can be formed and recorded on the microcapsule layer 14 of the image-forming sheet 10 in substantially the same manner as a conventional stamp is manipulated.

In particular, first, the power ON/OFF switch 120 is turned ON, and the stamp-type thermal writing device 78 is placed on the microcapsule layer 14 of the image-forming sheet 10. Then, the thermal writing device 78 is downwardly pressed against the image-forming sheet 10, a pressure, exerted by the rigid plate member 86 on the image-forming sheet 10, is abruptly increased, as indicated by a pressure characteristic PC in a graph of FIG. 21. When the downward pressing is continued until the peripheral edge face 100 of the box-like body 80 comes into contact with the microcapsule layer 14, the exerted pressure reaches at least 20 MPa. Thereafter, by gradually releasing the downward pressure from the thermal writing device 78, the exerted pressure is gradually reduced from 20 MPa toward 0 MPa, as shown in the graph of FIG. 21.

Figure 21:
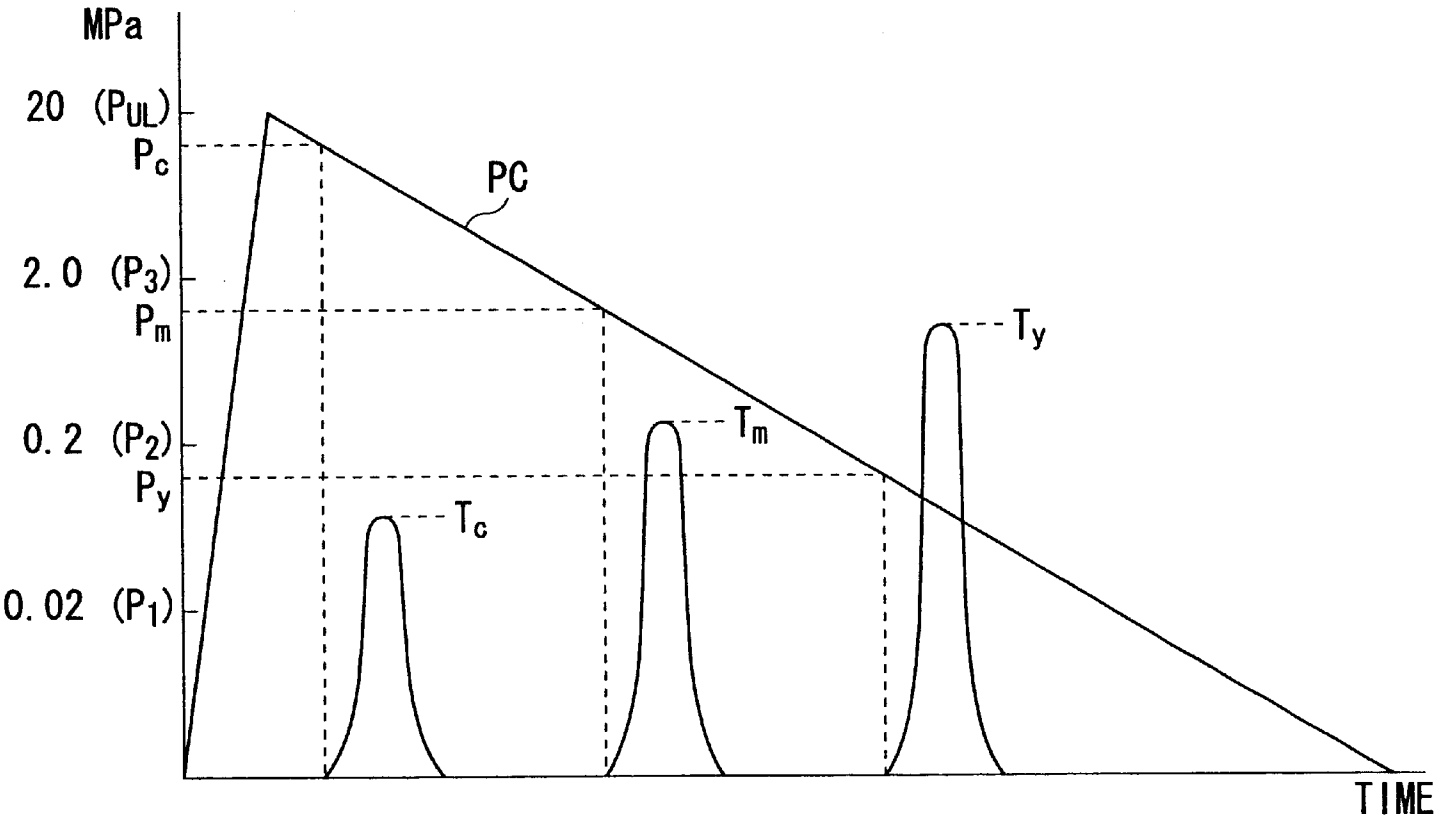
FIG. 21 is a graph showing a variation in a stamping pressure exerted by the stamp-type thermal writing device on the image-forming sheet of FIG. 1.

When the exerted pressure is lowered to a pressure $P_c$, being somewhat less than 20 MPa, the heater elements 82C are selectively and electrically energized in accordance with the frame of cyan image-pixel signals stored in the frame memory 104, and the selectively-energized heater elements 82C are heated to a temperature $T_c$, as shown in the graph of FIG. 21, whereby a cyan image is produced on the microcapsule layer 14 of the image-forming sheet 10. Note, the temperature $T_c$ is in the range between the glass-transition temperatures $T_1$ and $T_2$.

Then, when the exerted pressure is lowered to a pressure $P_m$, being somewhat less than 2.0 MPa, the heater elements 82M are selectively and electrically energized in accordance with the frame of magenta image-pixel signals stored in the frame memory 104, and the selectively-energized heater elements 82M are heated to a temperature $T_m$, as shown in the graph of FIG. 21, whereby a magenta image is produced on the microcapsule layer 14 of the image-forming sheet 10. Note, the temperature $T_m$ is in the range between the glass-transition temperatures $T_2$ and $T_3$.

Subsequently, when the exerted pressure is lowered to a pressure $P_y$, being somewhat less than 0.2 MPa, the heater elements 82Y are selectively and electrically energized in accordance with the frame of yellow image-pixel signals stored in the frame memory 104, and the selectively-energized heater elements 82Y are heated to a temperature $T_y$, as shown in the graph of FIG. 21, whereby a yellow image is produced on the microcapsule layer 14 of the image-forming sheet 10. Note, the temperature $T_y$ is in the range between the glass-transition temperature $T_3$ and the upper limit temperature $T_{UL}$.

Figure 22:
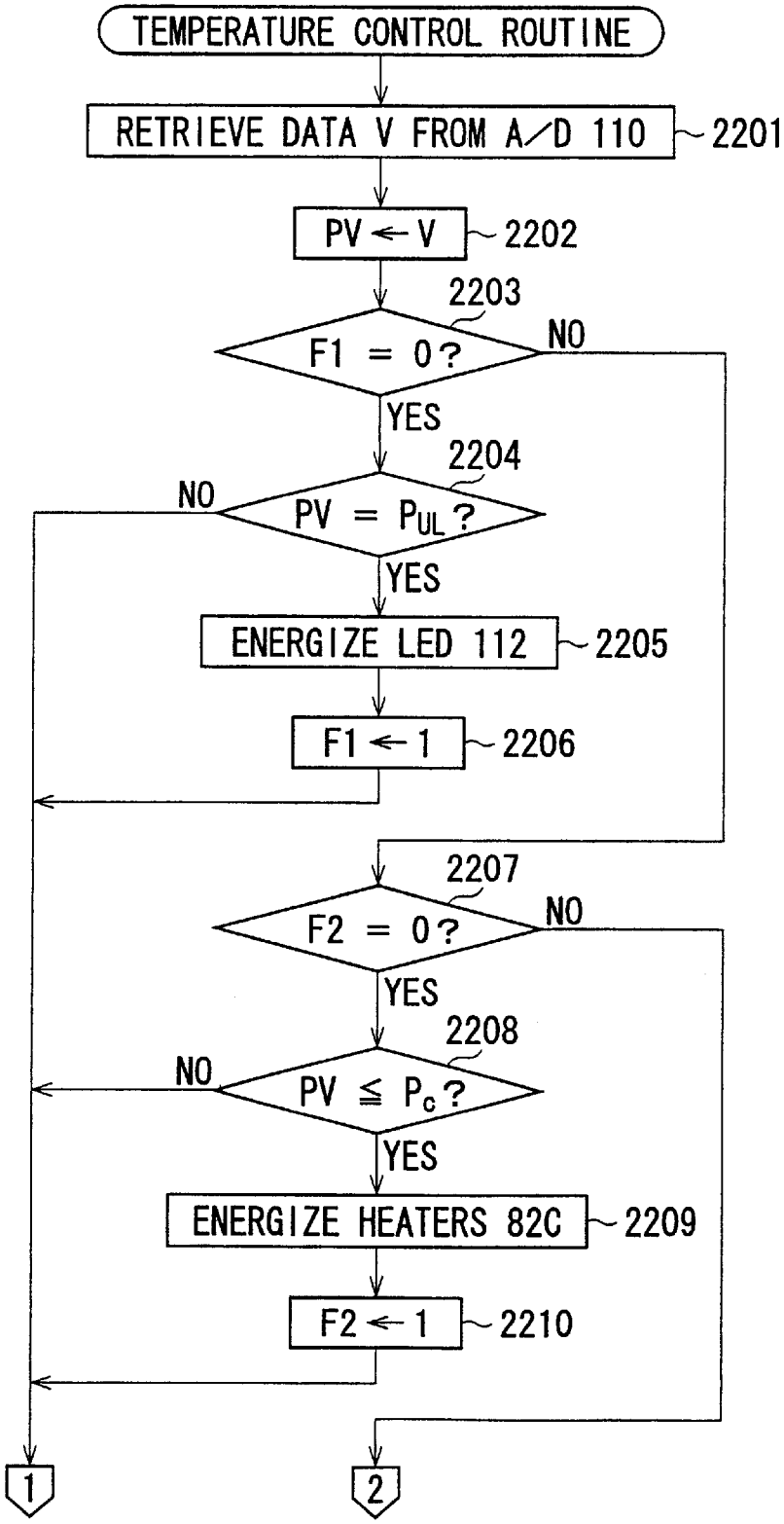
FIG. 22 is a part of a flowchart of a temperature control routine, executed in a microcomputer of a control circuit board shown in FIG. 20, for controlling a selective and electrical energization of the cyan, magenta and yellow heater elements of the stamp-type thermal writing device.
Figure 23:
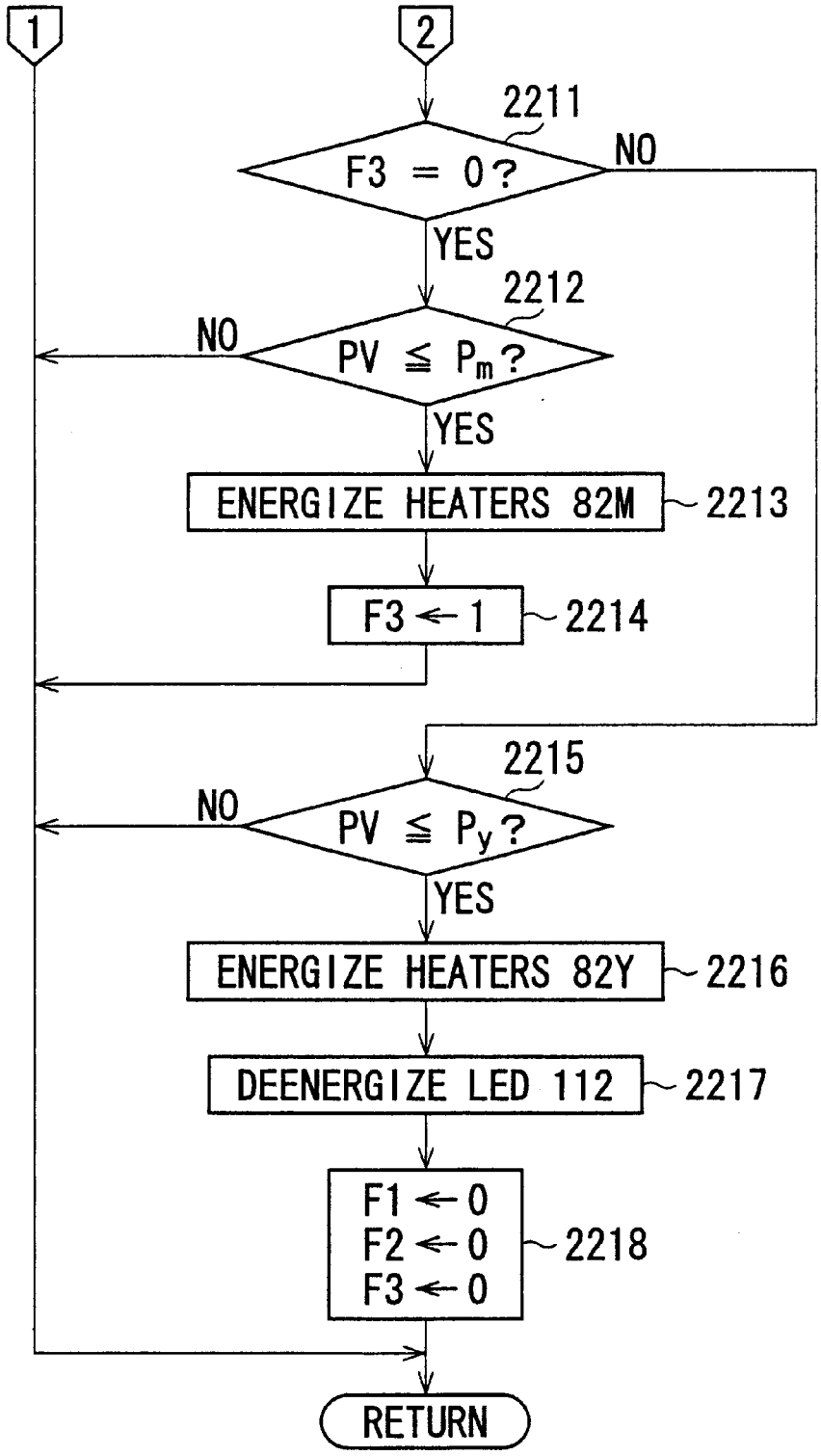
FIG. 23 is the remaining part of the flowchart of the temperature control routine referred to in FIG. 22.

FIGS. 22 and 23 show a flowchart of a temperature control routine, executed by the microcomputer of the control circuit board 102, by which the selective and electrical energization of the heater elements 82C, 82M and 82Y are controlled. This temperature control routine is constituted as a time-interruption routine, which is repeatedly executed at regular interval of, for example, 100 μsec, and the execution of this routine is started when the power ON/OFF switch 120 is turned ON.

At step 2201, the digital voltage data V is retrieved from the A/D converter 110 by the microcomputer of the control circuit board 102. Then, in step 2202, the retrieved voltage data V is converted into a pressure data PV on the basis of a one-dimensional calibration map previously stored in the ROM of the microcomputer.

At step 2203, it is determined whether a flag F1 is "0" or "1". At an initial stage, F1=0, so the control proceeds to step 2204, in which the converted pressure data PV reaches the upper limit pressure $P_{UL}$. If $PV<P_{UL}$, this routine once ends. Although the routine is repeatedly executed at regular interval of 100 μsec, there is no progress until it is confirmed that the converted pressure data PV has reached the upper limit pressure $P_{UL}$.

At step 2204, when it is confirmed that the converted pressure data PV has reached the upper limit pressure $P_{UL}$, the control proceeds to step 2205, the LED 112 is electrically energized (lit), thereby indicating to a user that a formation of a color image by the thermal writing device 78 is possible. Then, at step 2206, the flag F1 is made to be "1", and the routine once ends.

After 100 μsec has elapsed, the routine is again executed, whereby a digital voltage data V is retrieved from the A/D converter 110 by the microcomputer of the control circuit board 102 (step 2201), and the retrieved voltage data V is converted into a pressure data PV on the basis of a one-dimensional calibration map previously stored in the ROM of the microcomputer (step 2202).

Thereafter, the control skips from step 2203 to step 2207 (F1=1), in which it is determined whether a flag F2 is "0" or "1". At this stage, F2=0, so the control proceeds to step 2208, in which it is determined whether the converted pressure data PV has been lowered to the pressure $P_c$ (FIG. 21), being somewhat less than the upper limit pressure $P_{UL}$ (20 MPa). If $PV>P_c$, this routine once ends. Although the routine is repeatedly executed at regular intervals of 100 μsec, there is no progress until it is confirmed that a converted pressure data PV has been lowered to the pressure $P_c$.

When it is confirmed that a converted pressure data PV has been lowered to the pressure $P_c$, the control proceeds to step 2209, in which selective and electrical energization of the heater elements 82C in accordance with the frame of cyan image-pixel signals is started. Note, this selective and electrical energization is continued over a predetermined time period, whereby the selectively-energized heater elements 82C are heated to the temperature $T_c$ (FIG. 21). Then, at step 2210, the flag F2 is made to be "1", and the routine once ends.

After 100 μsec has elapsed, the routine is again executed, whereby a digital voltage data V is retrieved from the A/D converter 110 by the microcomputer of the control circuit board 102 (step 2201), and the retrieved voltage data V is converted into a pressure data PV on the basis of a one-dimensional calibration map previously stored in the ROM of the microcomputer (step 2202).

Thereafter, the control skips to step 2211 via step 2207 (F1=1, F2=1), in which it is determined whether a flag F3 is "0" or "1". At this stage, F3=0, so the control proceeds to step 2212, in which it is determined whether the converted pressure data PV has been lowered to the pressure $P_m$ (FIG. 21), being somewhat less than the pressure $P_3$ (2.0 MPa). If $PV>P_m$, this routine once ends. Although the routine is repeatedly executed at regular intervals of 100 μsec, there is no progress until it is confirmed that a converted pressure data PV has been lowered to the pressure $P_m$.

When it is confirmed that a converted pressure data PV has been lowered to the pressure $P_m$, the control proceeds to step 2213, in which selective and electrical energization of the heater elements 82M in accordance with the frame of magenta image-pixel signals is started. Note, this selective and electrical energization is continued over a predetermined time period, whereby the selectively-energized heater elements 82M are heated to the temperature $T_m$ (FIG. 21). Then, at step 2214, the flag F3 is made to be "1", and the routine once ends.

After 100 μsec has elapsed, the routine is again executed, whereby a digital voltage data V is retrieved from the A/D converter 110 by the microcomputer of the control circuit board 102 (step 2201), and the retrieved voltage data V is converted into a pressure data PV on the basis of a one-dimensional calibration map previously stored in the ROM of the microcomputer (step 2202).

Thereafter, the control skips to step 2215 via steps 2207 and 2211 (F1=1, F2=1, F3=1), in which it is determined whether the converted pressure data PV has been lowered to the pressure $P_y$ (FIG. 21), being somewhat the pressure $P_2$ (0.2 MPa). If $PV>P_2$, this routine once ends. Although the routine is repeatedly executed at regular intervals of 100 μsec, there is no progress until it is confirmed that a converted pressure data PV has been lowered to the pressure $P_y$.

When it is confirmed that a converted pressure data PV has been lowered to the pressure $P_y$, the control proceeds to step 2216, in which selective and electrical energization of the heater elements 82Y in accordance with the frame of yellow image-pixel signals is started. Note, this selective and electrical energization is continued over a predetermined time period, whereby the selectively-energized heater elements 82Y are heated to the temperature $T_y$ (FIG. 21). Then, at step 2217, the LED 112 is electrically deenergized, and, at step 2218, the flags F1, F1 and F3 are made to be "0".

Thus, a color image, based on cyan, magenta and yellow images, is obtained on the microcapsule layer 14 of the image-forming sheet 10.

Finally, it will be understood by those skilled in the art that the foregoing description is of preferred embodiments of the device, and that various changes and modifications may be made to the present invention without departing from the spirit and scope thereof.

The present disclosure relates to a subject matter contained in Japanese Patent Application No. 10-154027 (filed on Jun. 3, 1998) which is expressly incorporated herein, by reference, in its entirety.

What is claimed is:

1. A thermal writing device that forms an image on an image-forming substrate including a base member and a layer of microcapsules, coated over the base member, the layer containing microcapsules filled with a dye, the microcapsules exhibiting a pressure/temperature characteristic such that the microcapsules are squashed under a predetermined pressure at a temperature within a predetermined temperature range, the device comprising:

an elongated body, having a tip-end and configured to be handholdable;

a heater element movably provided on said tip-end of said elongated body, said heater element being positioned to extend beyond a level defined by an end face of said tip-end, when said heater element does not contact the image-forming substrate;

an elastic element, generating an elastic-force, provided in said tip-end of said elongated body and associated with said heater element to be elastically biased such that, when said tip-end of said elongated body is pressed against said image-forming substrate, said heater element is depressed against said elastic-force of said elastic member, thereby exerting said predetermined pressure on said image-forming substrate;

an electrical driver that electrically energizes said heater element to said temperature within said predetermined temperature range;

a determiner that determines whether said heater element is withdrawn from the extended position, to a level defined by said end face, when said tip-end of said elongated body is pressed against the image-forming substrate; and a controller that controls said electrical driver such that said electrical energization of said heater element is started, when the withdrawal of said heater elements from the extended position is confirmed by said determiner;

an indicator that indicates that said pressure, exerted by said heater element on said image-forming substrate, reaches said predetermined pressure, when the withdrawal of said heater elements from the extended position is confirmed by said determiner;

wherein a pressure, exerted by said heater element on said image-forming substrate, reaches said predetermined pressure when said heater element is withdrawn from the extended position, when said tip-end of said elongated body is pressed against said image-forming substrate.

2. A thermal writing device as set forth in claim 1, further comprising:

an adjuster that sets a temperature within said predetermined temperature range to which said heater element is heated; and a controller that controls said electrical energization of said heater element by said electrical driver such that a heating temperature of said heater element coincides with said temperature set by said adjuster.

3. A thermal writing device that forms an image on an image-forming substrate including a base member and a layer of microcapsules, coated over said base member, said layer containing a first type of microcapsule filled with a first dye, and a second type of microcapsule filled with a second dye, said first type of microcapsule exhibiting a first pressure/temperature characteristic such that said first type of microcapsule is squashed under a first predetermined pressure at a temperature within a first predetermined temperature range, said second type of microcapsule exhibiting a second/pressure temperature characteristic such that said second type of microcapsule is squashed under a second predetermined pressure at a temperature within a second predetermined temperature range, said device comprising:

an elongated body, having a tip-end and configured to be handholdable;

a first heater element movably provided on said tip-end of said elongated body;

a first elastic element, generating a first elastic-force, provided in said tip-end of said elongated body and associated with said first heater element to be elastically biased such that, when said tip-end of said elongated body is pressed against said image-forming substrate, said first heater element is depressed against said first elastic-force of said first elastic member, thereby exerting said first predetermined pressure on said image-forming substrate;

a first electrical driver that electrically energizes said first heater element to heat to a temperature within said first predetermined temperature range;

a second heater element movably provided on said tip-end of said elongated body;

a second elastic element, generating a second elastic-force, provided in said tip-end of said elongated body and associated with said second heater element to be elastically biased such that, when said tip-end of said elongated body is pressed against said image-forming substrate, said second heater element is depressed against said second elastic-force of said second elastic member, thereby exerting said second predetermined pressure on said image-forming substrate; and a second electrical driver that electrically energizes said second heater element to heat to a temperature within said second predetermined temperature range.

4. A thermal writing device as set forth in claim 3, wherein each of said first and second heater elements is positioned to protrude from an end face defined by said tip-end of said elongated body when separated from said image-forming substrate, and respective pressures, exerted by said first and second heater elements on said image-forming substrate, reach said first and second predetermined pressures when said heater element are depressed from said protruding positions to said end face by pressing said tip-end of said elongated body against said image-forming substrate.

5. The thermal writing device as set forth in claim 4, further comprising:

a determiner that determines whether said first and second heater elements are depressed from said protruding positions to said end face when said tip-end is pressed against said image-forming substrate;

a first controller that controls said first electrical driver such that said electrical energization of said first heater element is started when said depression of said first and second heater elements from said protruding position to said end face is confirmed by said determiner; and a second controller that controls said second electrical driver such that said electrical energization of said second heater element is started when said depression of said first and second heater elements from said protruding position to said end face is confirmed by said determiner.

6. A thermal writing device as set forth in claim 5, further comprising an indicator that indicates that said respective pressures, exerted by said first and second heater elements on said image-forming substrate, reach said first and second predetermined pressures when it is determined by said determiner that said first and second respective heater elements are depressed from said protruding positions to said end face when pressing said tip-end of said elongated body against said image-forming substrate.

7. A thermal writing device as set forth in claim 3, further comprising:

a first adjuster that sets a temperature within said first predetermined temperature range to which said first heater element is heated;

a first controller that controls said electrical energization of said first heater element by said first electrical driver such that a heating temperature of said first heater element coincides with said temperature set by said first adjuster;

a second adjuster that sets a temperature within said second predetermined temperature range to which said second heater element is heated; and a second controller that controls said electrical energization of said second heater element by said second electrical driver such that a heating temperature of said second heater element coincides with said temperature set by said second adjuster.

8. A thermal writing device that forms an image on an image-forming substrate including a base member and a layer of microcapsules, coated over said base member, containing microcapsules filled with a dye, said microcapsules exhibiting a pressure/temperature characteristic such that said microcapsules are squashed under a predetermined pressure range at a predetermined temperature, said device comprising:

a body member;

a plate member movably associated with said body;

an elastic element interposed between said body member and said plate member;

a plurality of heater elements regularly arranged over an outer surface of said plate member;

a pressure detector that detects a pressure exerted by said outer surface of said plate member on said image-forming substrate, when said body member is pressed against said image-forming substrate, said outer surface of said plate member being in contact with said image-forming substrate;

an electrical driver that selectively and electrically energizes said heater elements in accordance with image-pixel data;

a pressure-lowering monitor that monitors whether a pressure, once exerted by the outer surface of said plate member on said image-forming substrate and increased to more than a previously-set pressure falling in said predetermined pressure range, lowers to said previously-set pressure; and a controller that controls said electrical driver such that said selective and electrical energization of said heater elements is started and maintained over a predetermined time period to heat to said predetermined temperature, when it is confirmed by said monitor that said pressure exerted by the outer surface of said plate member on said image-forming substrate reaches said previously-set pressure.

9. A thermal writing device as set forth in claim 8, further comprising:

a maximum-pressure-reaching determiner that determines whether said pressure exerted by said outer surface of said plate member on said image-forming substrate reaches a maximum pressure defining said predetermined pressure range; and an indicator that indicates said pressure exerted by said outer surface of said plate member on said image-forming substrate reaches said maximum pressure defining said predetermined pressure range when it is determined by said maximum-pressure-reaching determiner, wherein said pressure-lowering monitor monitors whether said maximum pressure lowers to said previously-set pressure, and said controller controls said electrical driver such that said selective and electrical energization of said heater elements is started and maintained over said predetermined time period to heat to said predetermined temperature, when it is confirmed by said monitor that said maximum pressure exerted by the outer surface of said plate member on said image-forming substrate reaches said previously-set pressure.

10. A thermal writing device as set forth in claim 8, further comprising a memory that stores said image-pixel data.

11. A thermal writing device that forms an image on an image-forming substrate including a base member and a layer of microcapsules, coated over said base member, containing a first type of microcapsule filled with a first dye, and a second type of microcapsule filled with a second dye, said first type of microcapsule exhibiting a first pressure/temperature characteristic such that said first type of microcapsule is squashed under a first predetermined pressure range at a first predetermined temperature, said second type of microcapsule exhibiting a second pressure/temperature characteristic such that said second type of microcapsule is squashed under a second predetermined pressure range at a second predetermined temperature, said first predetermined pressure range being higher than said second predetermined pressure range, said first predetermined temperature being lower than said second predetermined temperature, said device comprising:

a body member;

a plate member movably associated with said body;

an elastic element interposed between said body member and said plate member;

a first type of heater element and a second type of heater element regularly arranged over an outer surface of said plate member;

a pressure detector that detects a pressure exerted by said outer surface of said plate member on said image-forming substrate, while said body member is pressed against said image-forming substrate, said outer surface of said plate member being in contact with said image-forming substrate;

a first electrical driver that selectively and electrically energizes said first type of heater element in accordance with first image-pixel data;

a second electrical driver that selectively and electrically energizes said second type of heater element in accordance with second image-pixel data;

a first pressure-lowering monitor that monitors whether a pressure, once exerted by the outer surface of said plate member on said image-forming substrate and increased to more than a first previously-set pressure falling in said first predetermined pressure range, lowers to said first previously-set pressure falling in said first predetermined pressure range;

a second pressure-lowering monitor that monitors whether said pressure exerted by the outer surface of said plate member on said image-forming substrate then lowers to a second previously-set pressure falling in said second predetermined pressure range;

a first controller that controls said first electrical driver such that the selective and electrical energization of said first type of heater element is started and maintained over a first predetermined time period to heat to said first predetermined temperature, when it is confirmed by said monitor that said pressure exerted by the outer surface of said plate member on said image-forming substrate reaches said first previously-set pressure; and a second controller that controls said second electrical driver such that said selective and electrical energization of said second type of heater element is started and maintained over a second predetermined time period to heat to said second predetermined temperature, when it is confirmed by said monitor that said pressure exerted by said outer surface of said plate member on said image-forming substrate reaches said second previously-set pressure.

12. A thermal writing device as set forth in claim 11, further comprising:

a maximum-pressure-reaching determiner that determines whether said pressure exerted by said outer surface of said plate member on said image-forming substrate reaches a maximum pressure defining said first predetermined pressure range; and an indicator that indicates said pressure exerted by said outer surface of said plate member on said image-forming substrate reaches said maximum pressure defining said first predetermined pressure range when it is determined by said maximum-pressure-reaching determiner, wherein said first pressure-lowering monitor monitors whether said maximum pressure lowers to said first previously-set pressures, said second pressure-lowering monitor monitors whether said maximum pressure lowers to said second previously-set pressure, said first controller controls said electrical driver such that said selective and electrical energization of said first heater elements is started and maintained over said first predetermined time period to heat to said first predetermined temperature, when it is confirmed by said monitor that said maximum pressure exerted by the outer surface of said plate member on said image-forming substrate reaches said first previously-set pressure, and said second controller controls said electrical driver such that said selective and electrical energization of said second heater elements is started and maintained over said second predetermined time period to heat to said second predetermined temperature, when it is confirmed by said monitor that said maximum pressure exerted by the outer surface of said plate member on said image-forming substrate reaches said second previously-set pressure.

13. A thermal writing device as set forth in claim 11, further comprising a memory that stores said first and second image-pixel data.

* * * * *